US009500983B2

(12) United States Patent
Tanaka et al.

(10) Patent No.: US 9,500,983 B2
(45) Date of Patent: Nov. 22, 2016

(54) IMAGE FORMING APPARATUS

(71) Applicants: Kayoko Tanaka, Tokyo (JP); Keita Sone, Kanagawa (JP); Kenji Kikuchi, Kanagawa (JP)

(72) Inventors: Kayoko Tanaka, Tokyo (JP); Keita Sone, Kanagawa (JP); Kenji Kikuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/203,708

(22) Filed: Mar. 11, 2014

(65) Prior Publication Data

US 2014/0270818 A1 Sep. 18, 2014

(30) Foreign Application Priority Data

Mar. 15, 2013 (JP) ..... 2013-053040

(51) Int. Cl.
*G03G 15/08* (2006.01)
*G03G 15/00* (2006.01)

(52) U.S. Cl.
CPC ..... *G03G 15/0856* (2013.01); *G03G 15/0879* (2013.01); *G03G 15/556* (2013.01); *G03G 15/0829* (2013.01); *G03G 15/0831* (2013.01); *G03G 15/0867* (2013.01); *G03G 15/0872* (2013.01)

(58) Field of Classification Search
CPC ..... G03G 15/0829; G03G 15/0831; G03G 15/0839; G03G 15/0867; G03G 15/08572; G03G 15/0879
USPC ..... 399/27, 30, 258, 260
See application file for complete search history.

(56) References Cited

U.S. PATENT DOCUMENTS

| | | | | |
|---|---|---|---|---|
| 2004/0151520 | A1* | 8/2004 | Phillips | G03G 15/0877 399/258 |
| 2006/0002724 | A1 | 1/2006 | Fujimori et al. | |
| 2007/0036566 | A1 | 2/2007 | Takeuchi et al. | |
| 2007/0223944 | A1* | 9/2007 | Mizuta | G03G 15/0893 399/27 |
| 2010/0086320 | A1 | 4/2010 | Koizumi et al. | |
| 2011/0158669 | A1* | 6/2011 | Kayahara | 399/53 |
| 2011/0206389 | A1* | 8/2011 | Naruse | G03G 15/0877 399/27 |

FOREIGN PATENT DOCUMENTS

| | | |
|---|---|---|
| JP | 2010-015110 | 1/2010 |
| JP | 2010-091785 | 4/2010 |
| JP | 2012-133349 | 7/2012 |
| JP | 2012133349 A * | 7/2012 |

* cited by examiner

*Primary Examiner* — David Gray
*Assistant Examiner* — Tyler Hardman
(74) *Attorney, Agent, or Firm* — Oblon, McClelland, Maier & Neustadt, L.L.P.

(57) ABSTRACT

An image forming apparatus includes an image bearer, a developing device to develop with developer a latent image formed on the image bearer, a developer container to contain developer, a temporary reservoir to temporarily store developer supplied from the developer container and having an outlet to discharge the temporarily stored developer to the developing device, a first conveyance device to transport developer from the developer container to the temporary reservoir, a second conveyance device to transport developer from the temporary reservoir to the developing device, a first developer amount detector to detect an amount of developer in the temporary reservoir, and a controller to control driving of the first conveyance device based on a detection result generated by the first developer amount detector and data relating to driving of the second conveyance device.

19 Claims, 14 Drawing Sheets

IMAGE FORMING APPARATUS

CROSS-REFERENCE TO RELATED APPLICATION

This patent application is based on and claims priority pursuant to 35 U.S.C. §119 to Japanese Patent Application No. 2013-053040, filed on Mar. 15, 2013, in the Japan Patent Office, the entire disclosure of which is hereby incorporated by reference herein.

BACKGROUND OF THE INVENTION

Technical Field

This invention generally relates to an image forming apparatus, such as a copier, a printer, a facsimile machine, and a multifunction peripheral (MFP) having at least two of coping, printing, facsimile transmission, plotting, and scanning capabilities.

Description of the Background Art

In image forming apparatuses, latent images formed on an image bearer such as a photoreceptor are developed with developer including at least toner. As toner is thus consumed in image development, toner is supplied by a toner replenishing device provided in the image forming apparatus. For example, JP-2012-133349-A proposes a configuration in which the toner replenishing device transports toner from a toner bottle to a developing device.

There are cylindrical toner bottles having a spiral protrusion protruding inward from an inner circumferential face thereof, and there are toner replenishing devices that include a temporary reservoir to temporarily store toner supplied from the toner bottle. Such a toner replenishing device further includes a first toner conveyance device to transport toner from the toner bottle to the temporary reservoir and a second conveyance device to transport toner from the temporary reservoir to the developing device. The first toner conveyance device is constructed of a bottle driving motor to rotate the toner bottle, the spiral protrusion formed in the inner circumferential face of the toner bottle, and the like.

In the state in which the toner bottle is mounted in the toner replenishing device, the toner bottle is rotated by driving force of the bottle driving motor. Then, toner is transported by the spiral protrusion to an opening formed in the toner bottle and supplied to the temporary reservoir.

The second conveyance device is constructed of a toner conveying screw, a driving motor to rotate the toner conveying screw, and the like. When the toner conveying screw is rotated by the driving motor, toner in the temporary reservoir is transported to an toner outlet and further to the developing device.

In such configurations including the temporary reservoir, even when almost all toner in the toner bottle is used up, toner can be supplied from the temporary reservoir to the developing device for a certain period, thus enabling printing operation.

Additionally, typically a toner amount detector is provided to an inner wall of the temporary reservoir to detect the presence of toner at a predetermined height (i.e., level), thereby detecting the amount of toner in the temporary reservoir. According to detection results generated by the toner amount detector, toner is supplied from the toner bottle to the temporary reservoir to keep the amount of toner in the temporary reservoir at a predetermined amount.

SUMMARY OF THE INVENTION

In view of the foregoing, one embodiment of the present invention provides an image forming apparatus that includes an image bearer on which a latent image is formed, a developing device to develop with developer the latent image formed on the image bearer, a developer container to contain developer, a temporary reservoir to temporarily store developer supplied from the developer container and having an outlet to discharge the temporarily stored developer to the developing device, a first conveyance device to transport developer from the developer container to the temporary reservoir, a second conveyance device to transport developer from the temporary reservoir to the developing device, a first developer amount detector to detect an amount of developer in the temporary reservoir, and a controller to control driving of the first conveyance device based on a detection result generated by the first developer amount detector and data relating to driving of the second conveyance device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
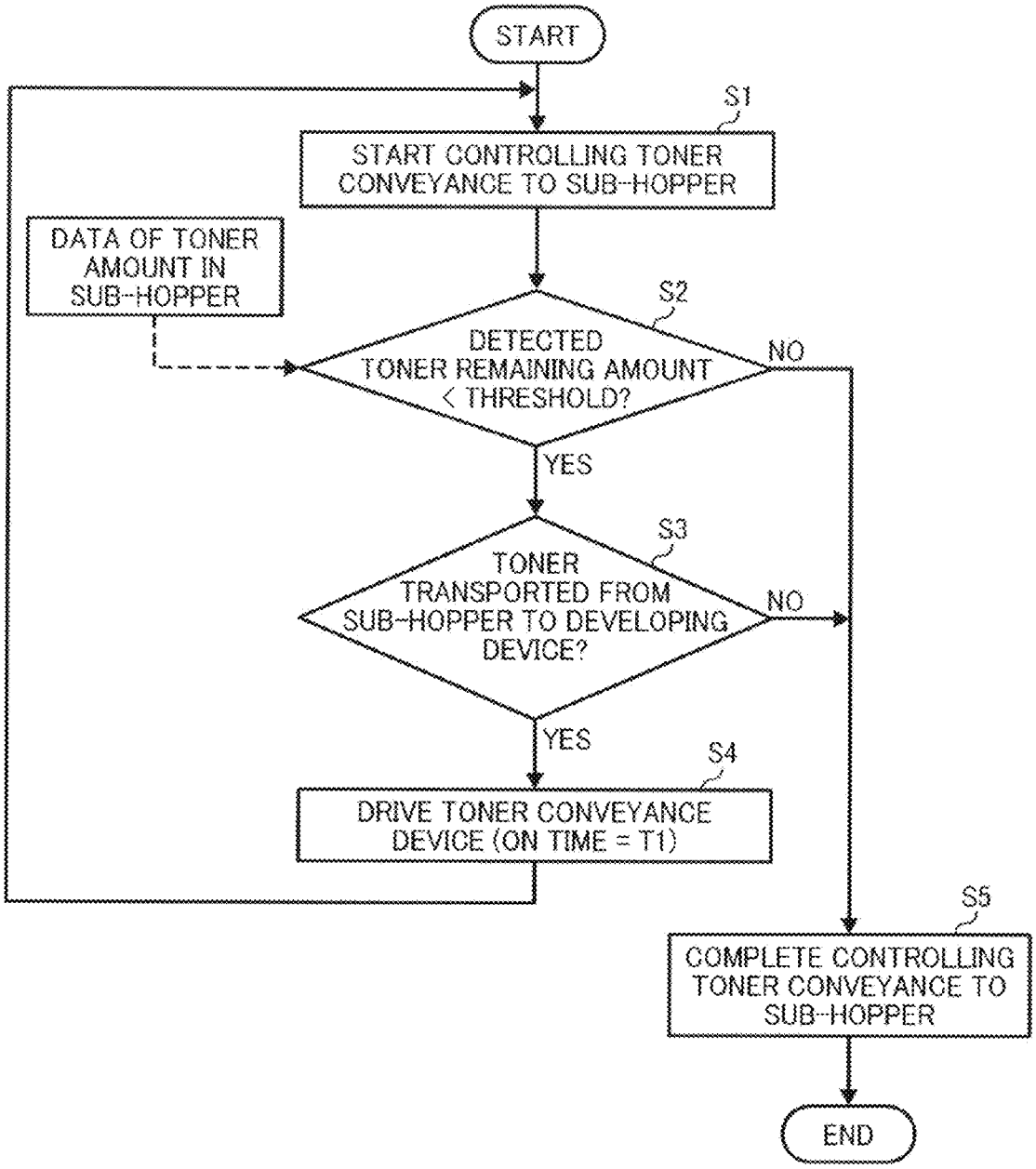
FIG. 1 is a flowchart illustrating a control procedure of toner conveyance from a toner bottle to a sub-hopper according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

There is the possibility of erroneous detection when toner is not present around the toner amount detector or the toner amount detector is out of order. It may be erroneously detected that the toner amount in the temporary reservoir is below the predetermined amount when the amount is still greater than the predetermined amount.

In this case, according to the erroneous detection result generated by the toner amount detector, toner supply to the temporary reservoir is kept. Accordingly, there are risks that the amount of toner supplied to the temporary reservoir exceeds the capacity thereof and that the temporary reservoir overflows with toner, causing toner leak.

An aim of the embodiment described below is to inhibit the temporary reservoir from overflowing with developer even when it is erroneously detected that the amount of developer in the temporary reservoir is smaller than the predetermined amount.

Figure 2:
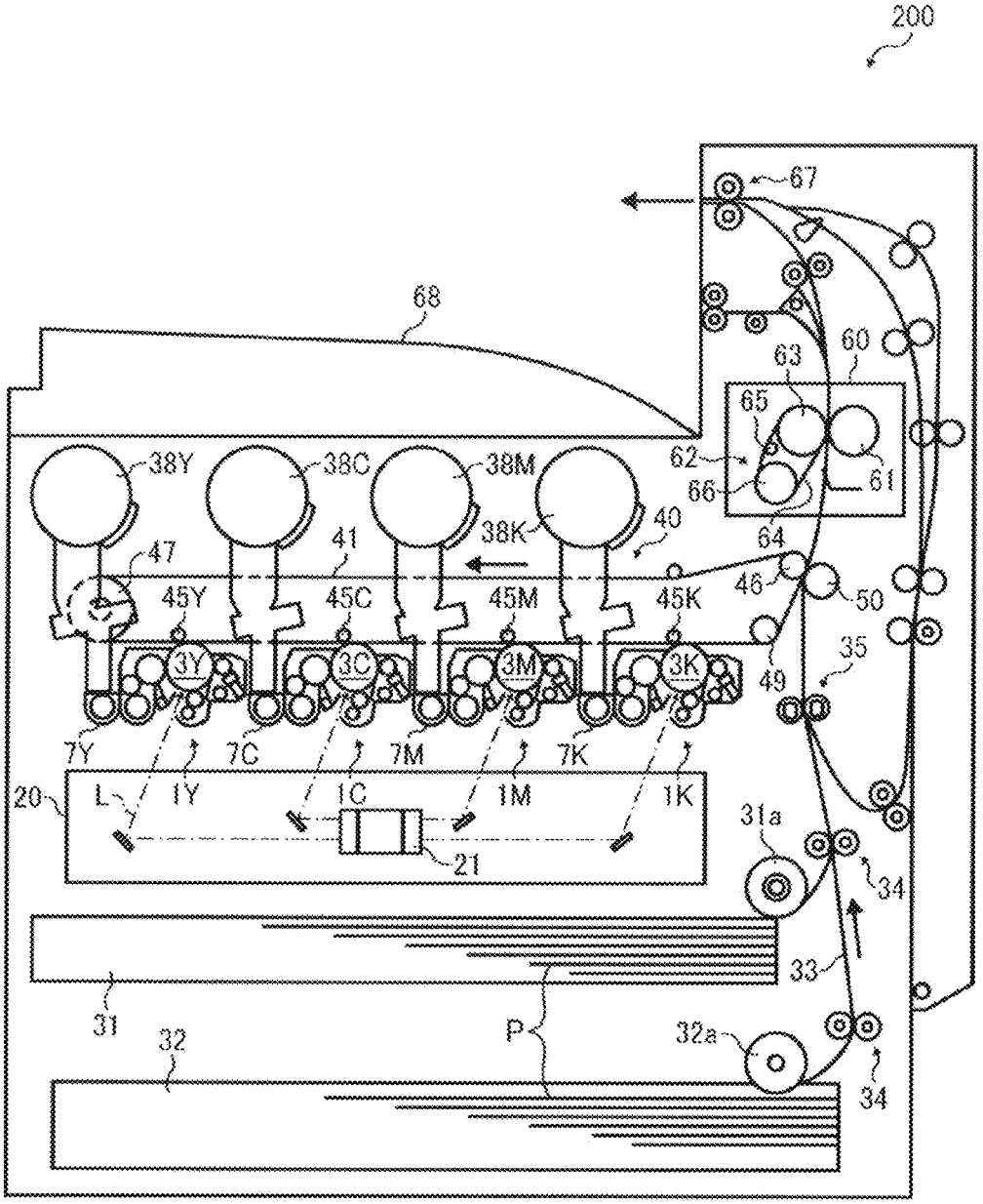
FIG. 2 is a schematic diagram illustrating an image forming apparatus according to an embodiment of the present invention.

Referring now to the drawings, wherein like reference numerals designate identical or corresponding parts throughout the several views thereof, and particularly to FIG. 2, a multicolor image forming apparatus according to an embodiment of the present invention is described. An image forming apparatus according to the present embodiment may be a multicolor laser printer.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

A basic configuration of the image forming apparatus according to the present embodiment is described below. FIG. 2 is a schematic diagram illustrating an image forming apparatus 200 according to the present embodiment.

The image forming apparatus 200 includes four process units 1Y, 1C, 1M, and 1K (i.e., image forming units) for forming yellow, cyan, magenta, and black toner images. The process units 1Y, 1C, 1M, and 1K have a similar configuration except that the color of toner used therein is different.

Figure 3:
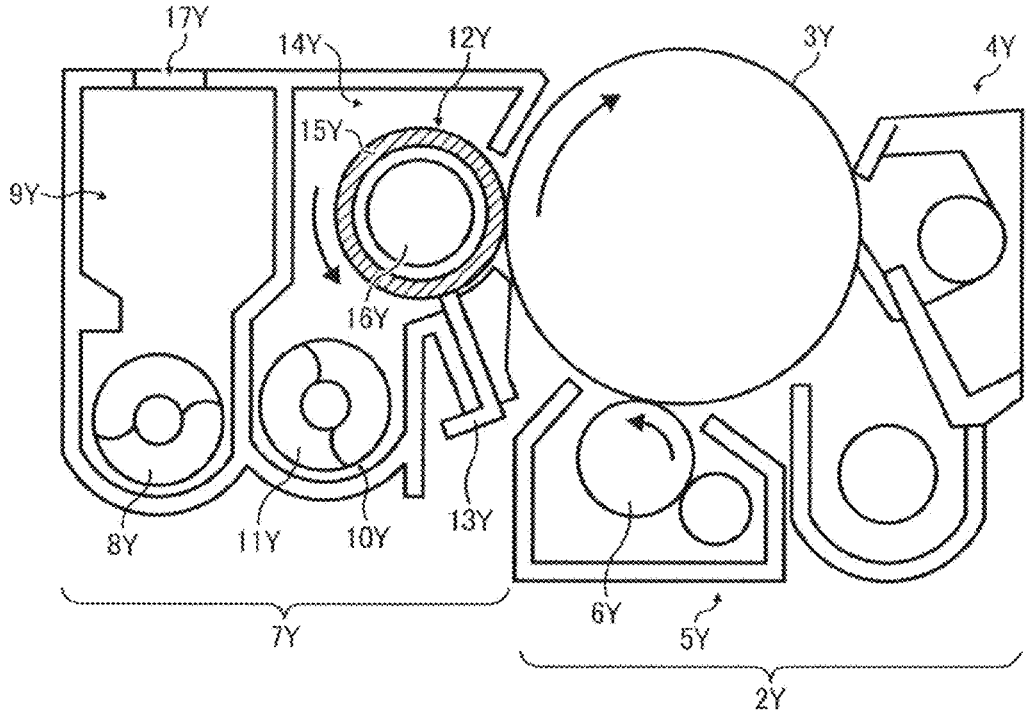
FIG. 3 is a schematic cross-sectional view illustrating a process unit of the image forming apparatus shown in FIG. 2.
Figure 4:
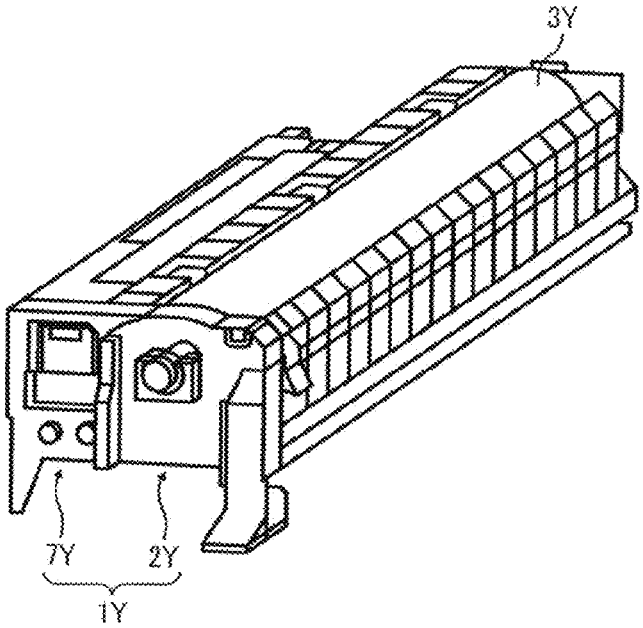
FIG. 4 is a perspective view illustrating an exterior of the process unit shown in FIG. 3.

FIG. 3 illustrates the process unit 1Y for forming yellow toner images. FIG. 4 is a perspective view illustrating an exterior of the process unit 1Y.

In the configuration shown in these drawings, the process unit 1Y includes two units, namely, a photoreceptor unit 2Y and a developing device 7Y. The photoreceptor unit 2Y and the developing device 7Y can be united into the process unit 1Y as shown in FIG. 4 and installed in and removed from an apparatus body together at a time.

The developing device 7Y is formed as a modular unit (i.e., a developing unit) that can be separated from the photoreceptor unit 2Y when removed from the apparatus body.

The photoreceptor unit 2Y includes a drum-shaped photoreceptor 3Y, a drum cleaning device 4Y, a discharger, and a charging device 5Y.

The charging device 5Y serving as a charging member causes a charging roller 6Y to uniformly charge the surface of the photoreceptor 3Y that is rotated clockwise in FIG. 2 by a driving unit. Specifically, while a power source applies a charging bias to the charging roller 6Y rotating counterclockwise in FIG. 3, the charging roller 6Y is disposed close to or in contact with the photoreceptor 3Y, thereby charging the photoreceptor 3Y uniformly.

It is to be noted that the charging member is not limited thereto. For example, the charging member may include, instead of the charging roller 6Y, a different charging member such as a charging brush disposed close to or in contact with the photoreceptor 3Y. Yet alternatively, chargers such as a scorotron charger to uniformly charge the photoreceptor 3Y by a charger method may be used. An optical writing unit 20 (shown in FIG. 2) described later directs a laser beam L onto the uniformly charged surface of the photoreceptor 3Y, thus forming an electrostatic latent image for yellow thereon.

Figure 5:
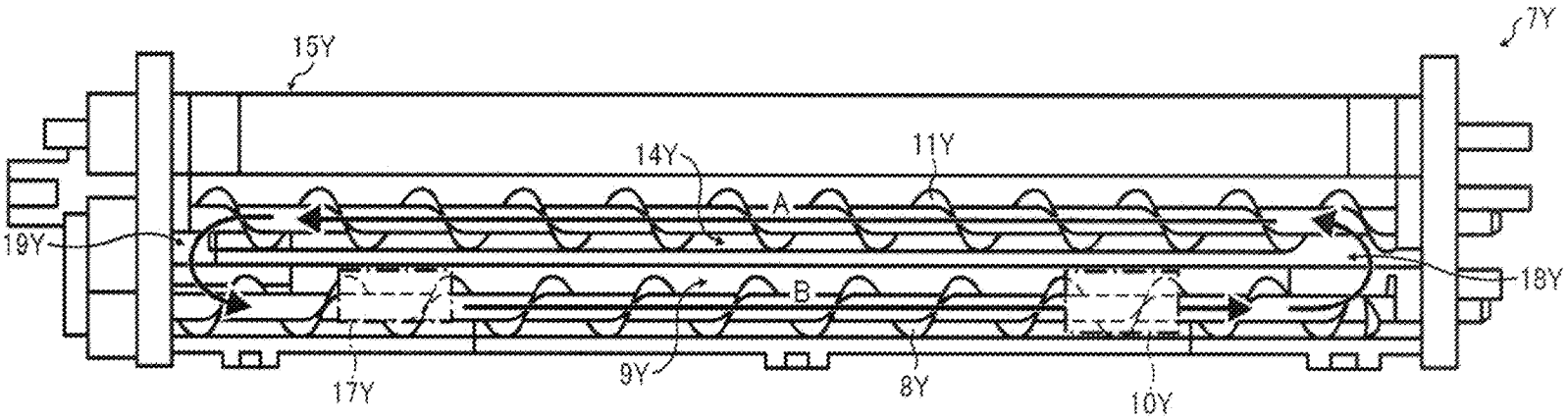
FIG. 5 is a schematic view illustrating an interior of a developing device according to an embodiment.

FIG. 5 is a schematic view illustrating an interior of the developing device 7Y. As shown in FIGS. 3 and 5, the developing device 7Y includes a first chamber 9Y in which a first conveying screw 8Y serving as a developer conveyance member is provided.

The developing device 7Y further includes a second chamber 14Y provided with a density sensor 10Y to detect the density of toner or the concentration of toner in developer, a second conveying screw 11Y, a developing roller 12Y serving as a developer bearer, and a doctor blade 13Y serving as a developer regulator. The density sensor 10Y may be a magnetic permeability sensor.

Two-component developer including magnetic carrier and negatively charged toner is contained in the first and second chambers 9Y and 14Y that together form a circulation channel.

Driven by a driving unit, the first conveying screw 8Y transports developer inside the first chamber 9Y to the proximal side in FIG. 3 (in the direction indicated by arrow B in FIG. 5). In the first chamber 9Y, a position facing a toner supply inlet 17Y is referred to a supply position. The density sensor 10Y is fixed above the first conveying screw 8Y and detect the concentration of toner in developer passing by a predetermined detection position that is downstream from the supply position in a direction in which developer is circulated (hereinafter "developer circulating direction"). Developer transported to the downstream end of the first chamber 9Y by the first conveying screw 8Y flows through a communicating opening 18Y into the second chamber 14Y.

The second conveying screw 11Y inside the second chamber 14Y rotates and transports developer to the distal side in FIG. 3 (in the direction indicated by arrow A in FIG. 5). Above the second conveying screw 11Y in FIG. 3, the developing roller 12Y is disposed in parallel to the second conveying screw 11Y.

The developing roller 12Y includes a developing sleeve 15Y that rotates counterclockwise in FIG. 3 and a stationary magnet roller 16Y provided inside the developing sleeve 15Y. The developing sleeve 15Y can be a nonmagnetic pipe, for example.

A part of developer transported by the second conveying screw 11Y is scooped onto the surface of developing sleeve 15Y due to magnetic force exerted by the magnet roller 16Y. The doctor blade 13Y is disposed across a predetermined gap from the surface of the developing sleeve 15Y and adjusts the layer thickness of developer carried on the developing sleeve 15Y, after which developer is transported to a development range facing the photoreceptor 3Y. Then, toner adheres to the electrostatic latent image formed on the photoreceptor 3Y. Thus, a yellow toner image is formed on the photoreceptor 3Y. After yellow toner therein is thus consumed, yellow developer is returned to the second conveying screw 11Y as the developing sleeve 15Y rotates.

Developer transported to the downstream end of the second chamber 14Y by the second conveying screw 11Y is returned through a communicating opening 19Y into the first chamber 9Y. Thus, yellow developer is circulated inside the developing device 7Y.

Figure 6:
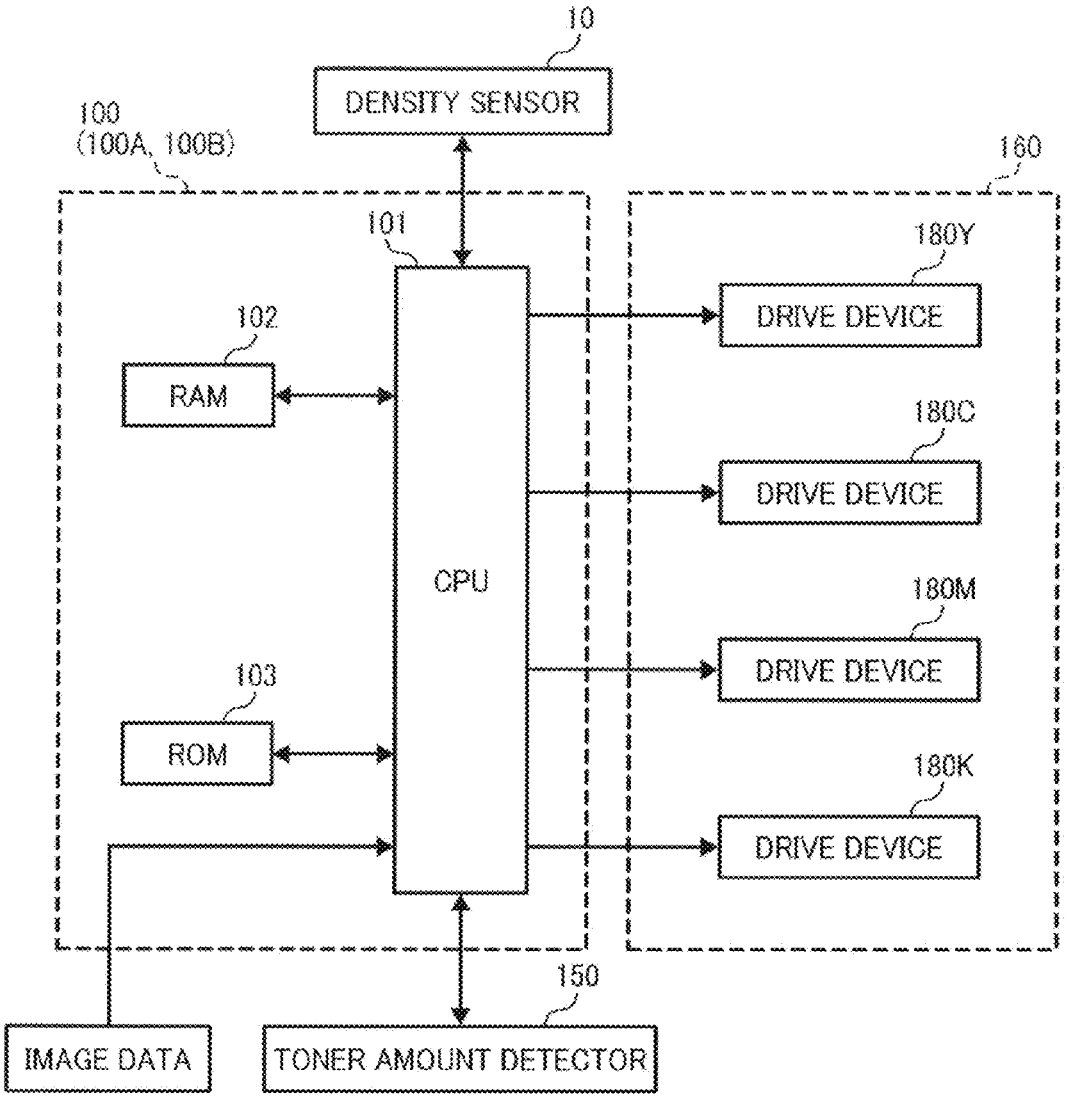
FIG. 6 is a block diagram illustrating electrical circuitry of the image forming apparatus shown in FIG. 2.

FIG. 6 is a block diagram illustrating electrical circuitry of the image forming apparatus 200 according to the present embodiment. A voltage indicating the magnetic permeability detected by the density sensor 10Y is transmitted to a controller 100 as electrical signals.

In FIG. 6, the controller 100 includes a central processing unit (CPU) 101 serving as a computing unit, a random access memory (RAM) 102, serving as a memory device, and a read only memory (ROM) 103, serving as a memory device. With this configuration, various types of computing and control programs can be executed.

The controller 100 stores in the RAM 102 target values Vtref for the respective colors that are targets of voltages output from the density sensor 10Y and other density sensors 10C, 10M, and 10K provided to the developing devices 7C, 7M, and 7K, respectively.

For supplying yellow toner, the controller 100 compares the voltage output from the density sensor 10Y with the target value Vtref for yellow and controls a drive device 180 for driving a toner replenishing device 160 (shown in FIG. 7) for yellow to supply toner in the amount corresponding to the comparison result from the toner supply inlet 17Y. Specifically, the controller 100 controls driving of driving motors 182A and 182B (shown in FIG. 8) of the drive device 180.

Then, yellow toner is supplied to the first chamber 9Y to compensate for the decrease in the concentration of yellow toner consumed in image development. Thus, the concentration of yellow toner in developer contained in the second chamber 14Y can be kept in a predetermined or desirable range. Similar toner supply control is performed in the developing devices 7C, 7M, and 7K.

Also connected to the controller 100 is a toner amount detector 150 that is provided to the toner replenishing device 160 and configured to detect the amount of toner inside a sub-hopper 163.

Referring back to FIG. 2, the yellow toner image is primarily transferred from the photoreceptor 3Y onto the intermediate transfer belt 41 serving as an intermediate transfer member. Then, the drum cleaning device 4Y removes toner remaining on the surface of the photoreceptor 2Y after the primary-transfer process. Further, a discharger electrically discharges the cleaned surface of the photoreceptor 3Y, and thus the photoreceptor 3Y is initialized in preparation for subsequent image formation.

In other process units 1 as well, toner images are formed on the respective photoreceptors 3 and primarily transferred onto the intermediate transfer belt 41.

The optical writing unit 20 is disposed beneath the process units 1 in FIG. 2. The optical writing unit 20 directs laser beams L onto the photoreceptors 3 in the respective process units 1 according to image data (pixel data) that the controller 100 acquires from externally connected devices, such as computers. Thus, electrostatic latent images for yellow, cyan, magenta, and black are formed on the respective photoreceptors 3.

It is to be noted that the optical writing unit 20 directs the laser beams L emitted from a light source to the respective photoreceptors 3 via multiple optical lenses and mirrors while deflecting the laser beams L with a polygon mirror 21 rotated by a motor. Instead of the above-described configuration, a light scanning mechanism employing a light-emitting diode (LED) array may be used.

Beneath the optical writing unit 20 in FIG. 2, first and second sheet trays 31 and 32 are arranged vertically. The sheet trays 31 and 32 contains piled multiple sheets P of recording media, and first and second feed rollers 31*a* and 32*a* are in contact with the sheets P on the top on the sheet trays 31 and 32, respectively.

When the first feed roller 31*a* is rotated counterclockwise in the drawing by a driving unit, the top sheet P in the sheet tray 31 is fed to a sheet feed channel 33 extending vertically on the right in the drawing.

When the second feed roller 32*a* is rotated counterclockwise in the drawing by the driving unit, the top sheet P in the sheet tray 32 is fed to the sheet feed channel 33.

Multiple pairs of conveyance rollers 34 are provided in the sheet feed channel 33, and the sheet P is sandwiched between the conveyance rollers 34 and transported upward in FIG. 2.

A pair of registration rollers 35 is provided at the downstream end of the sheet feed channel 33 in the direction in which the sheet P is conveyed (hereinafter "sheet conveyance direction"). The pair of registration rollers 35 stops rotating immediately after the sheet P is sandwiched therebetween and then forwards the sheet P to a secondary-transfer nip timed to coincide with image formation.

A transfer unit 40 is disposed above the process units 1. The transfer unit 40 rotates the intermediate transfer belt 41 counterclockwise in FIG. 2 while stretching the intermediate transfer belt 41.

The transfer unit 40 includes a belt cleaning unit and first and second brackets in addition to the intermediate transfer belt 41. The transfer unit 40 further includes four primary-transfer rollers 45Y, 45C, 45M, and 45K, a secondary-transfer backup roller 46, a driving roller 47, an auxiliary roller 48, and a tension roller 49.

While being stretched around these rollers, the intermediate transfer belt 41 is rotated counterclockwise in FIG. 2 as the driving roller 47 rotates. The four primary-transfer rollers 45 press against the respective photoreceptors 3 via the intermediate transfer belt 41, thus forming primary-transfer nips. Each primary-transfer roller 45 applies a transfer bias whose polarity (positive in the present embodiment) is opposite that of toner to the back surface (inside the loop) of the intermediate transfer belt 41.

As the intermediate transfer belt 41 rotates and passes through the four primary-transfer nips sequentially, the yellow, cyan, magenta, and black toner images are transferred from the photoreceptors 3Y, 3C, 3M, and 3K and superimposed one on another on the outer circumferential face of the intermediate transfer belt 41, thus forming a four-color toner image on the intermediate transfer belt 41.

The secondary-transfer backup roller 46 sandwiches the intermediate transfer belt 41 together with a secondary-transfer roller 50 disposed on the outer side of the loop thereof, thus forming a secondary-transfer nip therebetween.

The registration rollers 35 forward the sheet P clamped therebetween to the secondary-transfer nip, time to coincide with the four-color image on the intermediate transfer belt 41.

In the secondary-transfer nip, due to the effects of the secondary-transfer electrical field formed between the secondary-transfer roller 50 and the secondary-transfer backup roller 46 and nip pressure, the four-color toner image is transferred secondarily from the intermediate transfer belt 41 onto the sheet P at a time. Then, the four-color toner image becomes a full color toner image (hereinafter "multicolor toner image") on the while sheet P.

Then, the belt cleaning unit removes toner remaining on the intermediate transfer belt 41 after the intermediate transfer belt 41 passes the secondary-transfer nip. It is to be noted that the belt cleaning unit removes toner with a cleaning blade that contacts the front surface (outer circumferential surface) of the intermediate transfer belt 41.

It is to be noted that the first bracket of the transfer unit 40 pivots a predetermined rotational angle around the axis of rotation of the auxiliary roller 48 in accordance with on-off driving of a solenoid.

In the present embodiment, the first bracket is rotated a small rotational angle counterclockwise in the drawing by the driving of the solenoid in monochrome image formation. With this rotation, the primary-transfer rollers 45Y, 45M, and 45C revolve counterclockwise in the drawing around the axis of rotation of the auxiliary roller 48, thereby disengaging the intermediate transfer belt 41 from the photoreceptors 3Y, 3M, and 3K.

Then, monochrome images are formed by driving only the process unit 1Y out of the four process unit 1. This operation can eliminate wear of the process units 1Y, 1M, and 1Y resulting from unnecessary driving thereof during monochrome image formation.

Above the secondary-transfer nip in the drawing, a fixing device 60 to fix toner images on sheets of recording media is provided. The fixing device 60 includes a pressure roller 61 and a fixing belt unit 62. Inside the pressure roller 61, a heat source such as a halogen lamp is provided.

The fixing belt unit 62 includes a fixing belt 64, a heating roller 63 including a heat source 63*a* such as a halogen lamp, a tension roller 65, a driving roller 66, and a temperature detector.

The fixing belt 64, which is an endless belt, is stretched around the heating roller 63, the tension roller 65, and the driving roller 66 and rotated counterclockwise in the drawing. While rotating, the fixing belt 64 is heated by the heating roller 63 from the back side (inner face). The pressure roller 61 rotates clockwise in FIG. 2 and contacts, from the front side (outer face), a portion of the fixing belt 64 stretched around the heating roller 63. With this configuration, a fixing nip is formed between the pressure roller 61 and the fixing belt 64 pressing against each other.

Outside the loop of the fixing belt 64, a temperature sensor is disposed facing the outer face of the fixing belt 64 across a predetermined clearance to detect the surface temperature of the fixing belt 64 immediately before entering the fixing nip. The results of detection are transmitted to a fixing power supply circuit.

The fixing power supply circuit turns on and off power supply to the heat source 63*a* inside the heating roller 63 and the heat source inside the pressure roller 61 according to the detection results generated by the temperature sensor. Thus, the surface temperature of the fixing belt 64 is kept at, for example, about 140°.

After passing through the secondary-transfer nip, the sheet P leaves the intermediate transfer belt 41 and enters the fixing device 60. While the sheet P is nipped in the fixing nip of the fixing device 60 and transported upward in FIG. 2, the fixing belt 64 and the pressure roller 61 heat and press the sheet P, thereby fixing the toner image thereon.

Subsequently, the sheet P is discharged by a pair of discharge rollers 67 outside the image forming apparatus. The sheets P discharged by the discharge rollers 67 are sequentially stacked on a stack portion 68 formed on an upper face of the apparatus body.

Substantially cylindrical toner bottles 38Y, 38C, 38M, and 38K serving as toner containers for containing yellow, cyan, magenta, and black toners, respectively, are provided in a bottle mount above the transfer unit 40. It is to be noted that the term "cylindrical" used in this specification is not limited to round columns but also includes polygonal prisms.

The respective color toners in the toner bottles 38Y, 38C, 38M, and 38K are supplied to the developing devices 7Y, 7C, 7M, and 7K in the process units 1Y, 1C, 1M, and 1K as required. The toner bottles 38Y, 38C, 38M, and 38K can be installed in and removed from the apparatus body separately from the process units 1Y, 1C, 1M, and 1K.

As described above with reference to FIG. 5, the density sensor 10Y detects the density of toner in the first chamber 9Y, which is referred to as a non-supply range relative to the second chamber 14Y that is a supply range. That is, the density sensor 10Y detects the concentration of toner in developer immediately before entering the second chamber 14Y.

The toner supply inlet 17Y is disposed in an upstream portion of the second chamber 14Y in the direction indicated by arrow B shown in FIG. 5 so that toner is supplied to the developer immediately after entering the first chamber 9Y from the second chamber 14Y. In other words, the density sensor 10Y detects the concentration of toner in developer downstream from the toner supply inlet 17Y in the first chamber 9Y.

Figure 7:
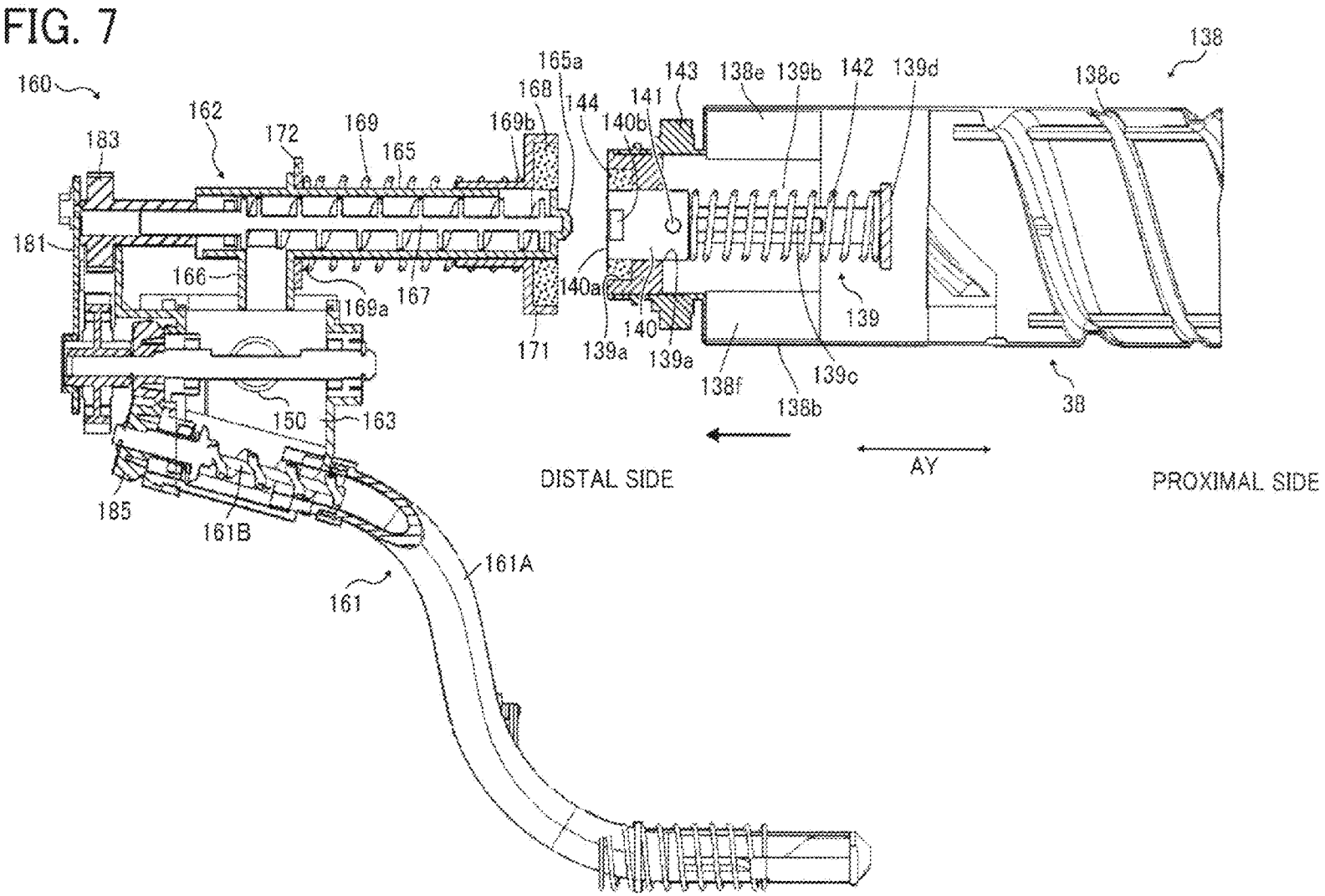
FIG. 7 is a partial cross-sectional view illustrating a configuration of a toner replenishing device provided with a toner bottle, according to an embodiment.

FIG. 7 is a partial cross-sectional view illustrating a configuration of the toner replenishing device 160 provided with the toner bottle 38. It is to be noted that arrow AY shown in FIGS. 7 and 9 indicates the longitudinal direction of the toner bottle 38.

The toner bottle 38 shown in FIG. 7 includes a container body 138, inside which toner is stored, and a nozzle receiving mouth 139*a* is formed in a second end portion (on a second end side 138*b* shown in FIG. 8) of the container body 138. Into the nozzle receiving mouth 139*a*, a conveying nozzle 162 provided with a powder inlet 170 is inserted. The toner bottle 38 further includes a nozzle receiver 139, and a supply inlet 139*b* is formed, at least partly, in the nozzle receiver 139 to supply toner (i.e., powder) contained in the container body 138 to the powder inlet 170. Further, a shutter 140 supported by the nozzle receiver 139 is provided. As the conveying nozzle 162 is inserted into and pulled out from the nozzle receiver 139, the shutter 140 slides to open and close the nozzle receiving mouth 139*a*. The nozzle receiver 139 is fixed to the container body 138 and rotates together as the container body 138 rotates.

The tubular container body 138 includes a spiral protrusion 138*c* protruding inward from an inner circumferential face thereof. The spiral protrusion 138*c* extends from a first end side 138*a* (shown in FIG. 8) to the second end side 138*b*. The spiral protrusion 138*c* is configured to transport toner contained therein from the first end side 138*a* to the second end side 138*b* as the container body 138 rotates.

An opening 138*d* into which the nozzle receiver 139 is inserted is formed in an end face on the second end side 138*b* of the container body 138. Further, scooping portions 138*e* and 138*f* are formed on the second end side 138*b*. Toner transported by the spiral protrusion 138*c* accumulates in a lower part of the second end side 138*b*. Additionally, there are toner accumulating in the lower part of the second end side 138*b* from the beginning. The scooping portions 138*e* and 138*f* scoop such accumulating toner upward in the container body 138 as the container body 138 rotates. Further formed on the second end side 138*b* is a gear 143 to which driving force for rotating the container body 138 is transmitted. The gear 143 is formed integrally with the container body 138.

In the present embodiment, the scooping portions 138*e* and 138*f* are arranged to oppose to each other with their phases shifted by 180 degrees. Although the two scooping portions 138*e* and 138*f* are provided in the present embodiment, instead, only one of scooping portions 138*e* and 138*f* may be provided. Alternatively, four multiple scooping portions may be arranged with their phases shifted by 90 degrees. Yet alternatively, five or more scooping portions may be provided. The number and shape of the scooping portions can be designed freely as long as the scooping portions can supply toner from above to the supply inlet 139*b* and the powder inlet 170, to be described later.

The nozzle receiver 139 is substantially cylindrical and extends in a longitudinal direction of the container body 138. As shown in FIG. 4, the nozzle receiving mouth 139*a* is formed on one end of the nozzle receiver 139 to fit in the opening 138*d* formed in the container body 138.

On the outer circumferential face of the nozzle receiver 139, a pair of slits 139*c* is formed, extending in the longitudinal direction of the nozzle receiver 139. The slits 139*c* are opposed to each other. The supply inlet 139*b* is formed in the outer circumferential face of the nozzle receiver 139 and extends long in the longitudinal direction of the nozzle receiver 139.

The nozzle receiving mouth 139*a* and the supply inlet 139*b* communicate with each other in the nozzle receiver 139. The supply inlet 139*b* is formed to present, at least partly, in a movable range of the shutter 140. A ring-shaped seal member 144 constructed of, for example, sponge is attached inside the nozzle receiving mouth 139*a* to inhibit leak of toner.

The shutter 140 is shaped like a plug (i.e., tubular) and inserted into the nozzle receiver 139. A pin 141 penetrates the shutter 140 in the direction of diameter. As the pin 141 is supported in each slit 139*c* of the nozzle receiver 139, the shutter 140 is supported movably in the longitudinal direction of the nozzle receiver 139.

A coil spring 142 serving as a biasing member is interposed between an end face 139*d* of the nozzle receiver 139, which is on the side opposite the nozzle receiving mouth 139*a*, and the shutter 140.

The shutter 140 is urged by the coil spring 142 to a position to close the nozzle receiving mouth 139*a* (hereinafter "closing position"), as shown in FIG. 7. When the shutter 140 occupies the closing position, the shutter 140 closes the nozzle receiving mouth 139*a* and further a part of the supply inlet 139*b*.

The shutter 140 is configured such that when the conveying nozzle 162 is inserted into the nozzle receiver 139, the shutter 140 slides into the container body 138 from the closing position shown in FIG. 7 to open the nozzle receiving mouth 139*a* and the supply inlet 139*b*. In addition, the shutter 140 further moves to an open position shown in FIG. 9 to make the nozzle receiving mouth 139*a* and the supply inlet 139*b* communicating with each other.

In the present embodiment, the opening area of the supply inlet 139*b* extends to a position adjacent to the nozzle receiving mouth 139*a*. Accordingly, the nozzle receiving mouth 139*a* and the supply inlet 139*b* are closed when the shutter 140 is at the closing position. By contrast, if the supply inlet 139*b* is positioned closer to the end face 139*d*, only the nozzle receiving mouth 139*a* is closed when the shutter 140 is at the closing position.

The toner bottle 38 configured as described above is installed by sliding the toner bottle 38 from a proximal side to a distal side of the apparatus body with the second end side 138*b* of the container body 138*s* located on a distal side of the container mount.

Figure 8:
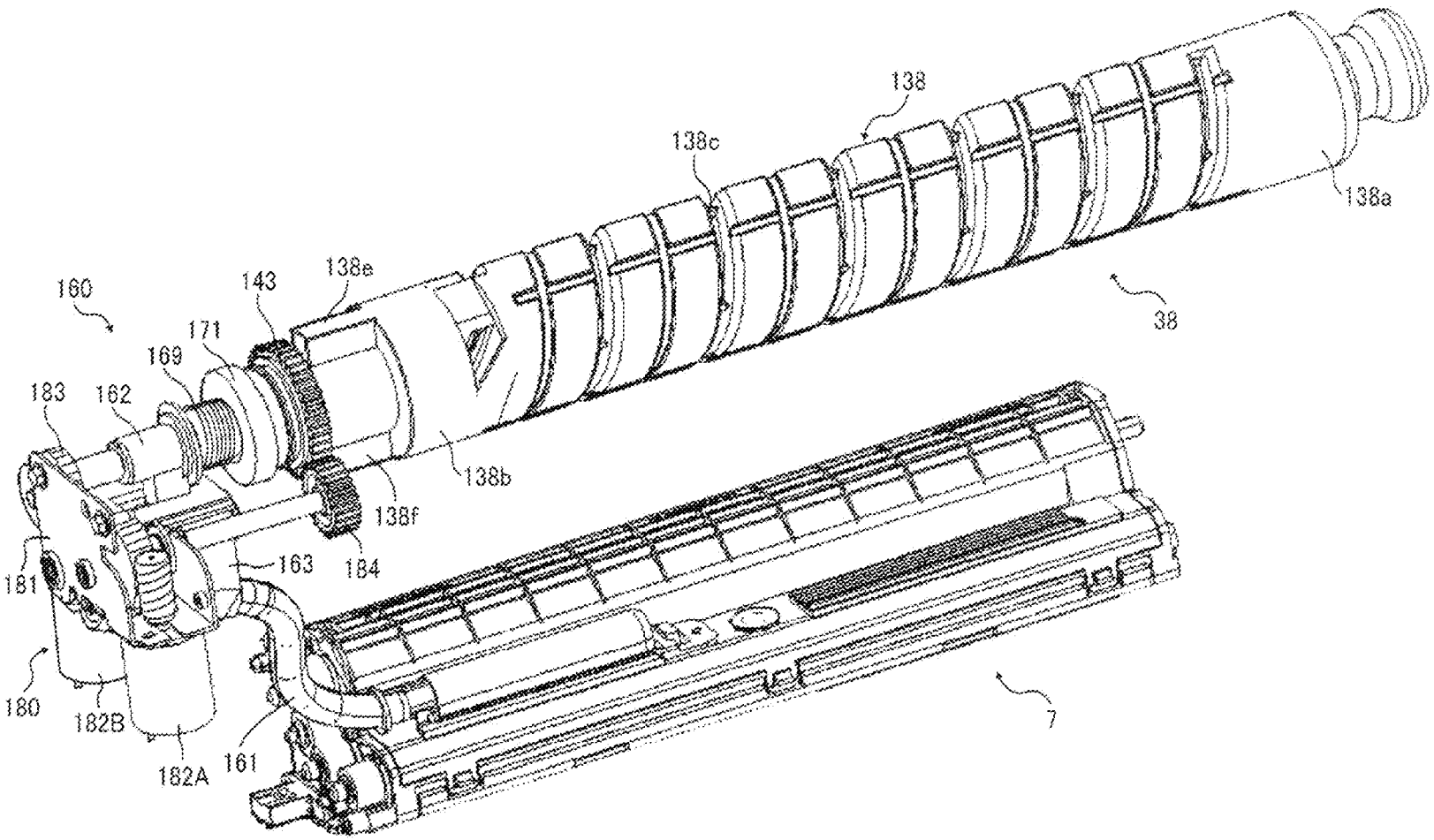
FIG. 8 is a perspective view illustrating an entire exterior of the toner replenishing device shown in FIG. 7.
Figure 9:
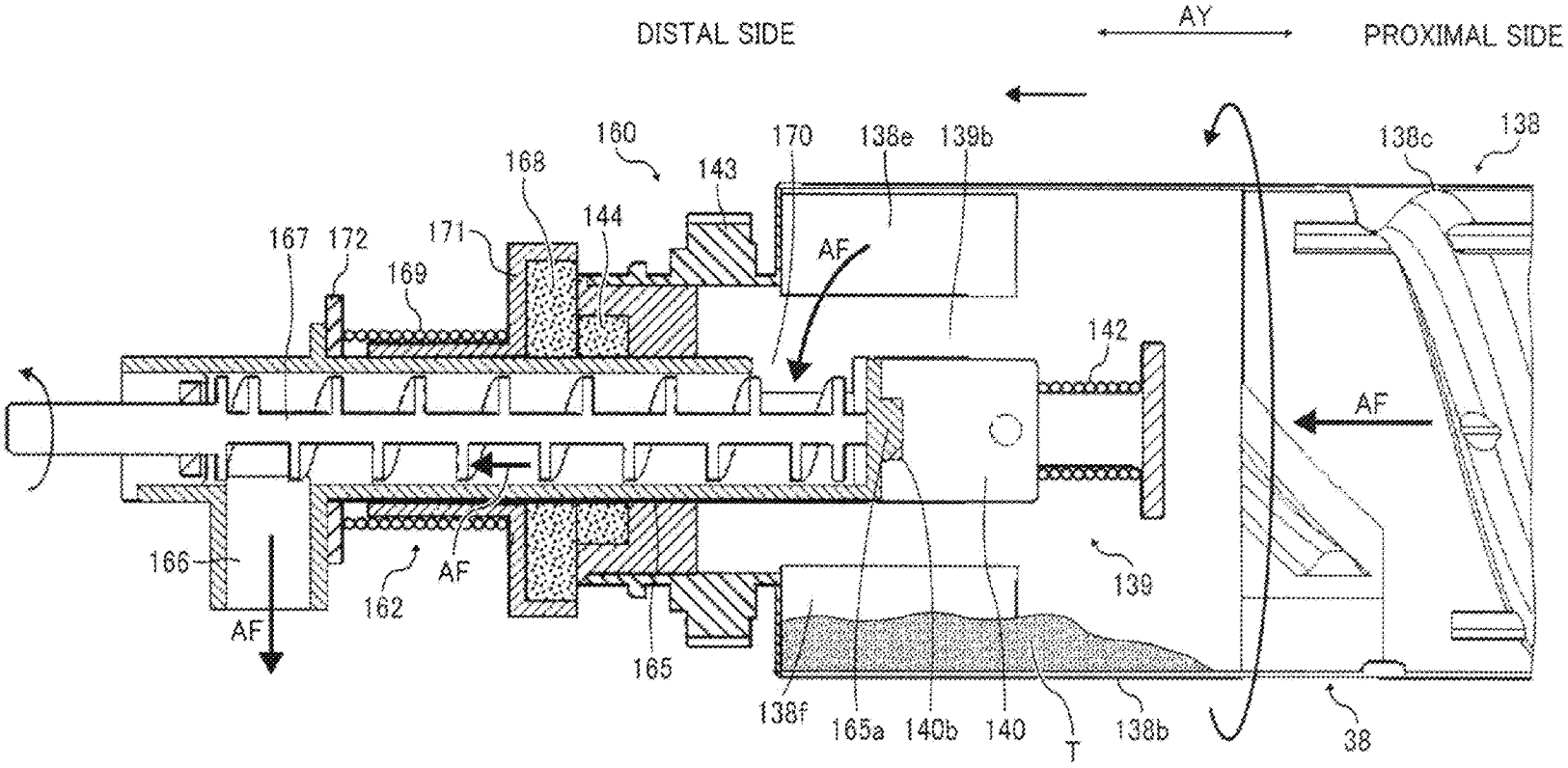
FIG. 9 is a cross-sectional view along an axial direction of the toner bottle shown in FIG. 7, with a conveying nozzle connected thereto.

FIG. 8 illustrates the toner replenishing device 160 entirely. FIG. 9 is a cross-sectional view along an axial direction of the toner bottle 38, with the conveying nozzle 162 connected thereto.

It is to be noted that, in FIG. 9, reference character T represent toner, and arrows AF indicate the direction of flow of toner.

The toner replenishing device 160 includes the toner bottle 38, the conveying nozzle 162, and a conveyance channel 161. The conveyance channel 161 is connected to the conveying nozzle 162 and the developing device 7 for transporting toner supplied to the conveying nozzle 162 to the developing device 7.

The conveying nozzle 162 is arranged on the distal side of the container mount (the apparatus body) to be opposed to the shutter 140 that is inserted into the container mount.

The sub-hopper 163 for storing toner to be transported by the conveying nozzle 162 is provided between the conveying nozzle 162 and the conveyance channel 161, and the toner is supplied to the conveyance channel 161 via the sub-hopper 163.

Additionally, the toner amount detector 150 to detect the amount of toner in the sub-hopper 163 is provided to an inner wall of the sub-hopper 163. Use of a piezoelectric sensor or an optical sensor as the toner amount detector 150 is advantageous in that toner amount detection can be attained at a lower cost.

As shown in FIG. 7, the conveyance channel 161 includes a hose 161A and a conveying screw 161B provided in the hose 161A. The conveying screw 161B transports toner from the sub-hopper 163 to the developing device 7 by rotating.

The conveying nozzle 162 includes a tubular nozzle section 165 to be inserted into the nozzle receiver 139 of the toner bottle 38, a connection channel 166 connecting the nozzle section 165 and the sub-hopper 163, and a conveying screw 167 disposed in the nozzle section 165 for transporting toner supplied from the toner bottle 38 to the connection channel 166. The conveying nozzle 162 further includes a seal member 168 and a coil spring 169 as a biasing member. The seal member 168 contacts the seal member 144 of the shutter 140, thereby forming a sealing face.

The nozzle section 165 extends in the longitudinal direction of the toner bottle 38 and has an outer diameter insertable into the nozzle receiver 139 from the nozzle receiving mouth 139*a*. The powder inlet 170 (shown in FIG. 9) is formed in the outer circumferential face in an end portion of the nozzle section 165. The powder inlet 170 receives toner from the supply inlet 139*b* of the toner bottle 38 and guides the toner to the conveying screw 167.

The length of the nozzle section 165 is set so that the powder inlet 170 can be opposed to the supply inlet 139*b* when the nozzle section 165 is inserted into the nozzle receiver 139.

The connection channel 166 is formed integrally with a base end of the nozzle section 165 located on the opposite side of the powder inlet 170, and communicates with the nozzle section 165. The powder inlet 170 is formed in a top face of the nozzle section 165.

A screw section of the conveying screw 167 extends from the end of the nozzle section 165 to the connection channel 166, and the conveying screw 167 is rotatably supported by the nozzle section 165. The seal member 168, formed of sponge and shaped like a ring, is attached to a holder 171 supported movably in the longitudinal direction on the outer circumferential face of the nozzle section 165.

A first end 169*a* of the coil spring 139 is latched on a spring receiving member 172 held on the outer circumferential face of the nozzle section 165. A second end 169*b* of the coil spring 169 is latched on the holder 171 that is held slidably on the outer circumferential face of the nozzle section 165 and rotatably about the axis center. In this state, the coil spring 169 urges the seal member 168 toward the seal member 144 (in a direction in which the holder 171 moves away from the spring receiving member 172).

The powder inlet 170 (shown in FIG. 9) is formed to be opposed to the supply inlet 139*b* of the nozzle receiver 139 when the nozzle section 165 is inserted into the container body 138 from the nozzle receiving mouth 139*a* of the nozzle receiver 139. Simultaneously, the powder inlet 170 communicates with the supply inlet 139*b* at an inner position beyond the gear 143 in the axial direction (longitudinal direction) of the container body 138.

The drive device 180 of the toner replenishing device 160 will be described. As shown in FIG. 8, the drive device 180 includes the driving motors 182A and 182B serving as first and second drive sources and gears 183, 184, and 185. For example, the driving motors 182A and 182B are fixed to a frame 181. The gear 183 is fixed to an end of the conveying screw 167. The gear 184 meshes with the gear 143 of the container body 138 when the toner bottle 38 is mounted in the container mount. The gear 185 is fixed to an end of the conveying screw 161B shown in FIG. 7. The drive device 180 further includes a gear train that meshes with the gears 183 to 185 and transmits rotation of the driving motors 182A and 182B to each gear.

The driving motors 182A and 182B are rotated for a certain period of time by the controller 100 when the controller 100 detects a toner supply signal with the toner bottle 38 mounted in the container mount.

In the toner replenishing device 160 shown in FIG. 7, a recess 140*b* is formed in an end face 140*a* of the shutter 140, and a protrusion 165*a* that fits in the recess 140*b* is formed at the end of the nozzle section 165. When the toner bottle 38 rotates, the shutter 140 held by the nozzle receiver 139 also rotates integrally. The rotation, however, is not hindered since contact faces of the recess 140*b* and the protrusion 165*a* are made slidable.

In addition, in the toner bottle 38, since the nozzle receiver 139 is fixed to and integrated with the container body 138, relative positions therebetween is established once the nozzle receiver 139 is fixed. Thus, the relative positions are arranged such that, when the nozzle receiver 139 is fixed to the container body 138, at least the supply inlet 139*b* is opposed to the scooping portion 138*e* or 138*f* of the container body 138 and located at a position where toner lifted by the scooping portion 138*e* or 138*f* drops.

In the configuration shown in FIGS. 7 and 9, the powder inlet 170 is formed on the top face of the nozzle section 165, and its orientation remains unchanged when the toner bottle 38 rotates. This configuration is preferable since toner in the toner bottle 38 can be reliably supplied to the powder inlet 170 when the recess 140*c* and the protrusion 165*b* are formed so that the supply inlet 139*b* faces the top face when the toner bottle 38 is mounted in the container mount.

With reference to FIG. 7 to FIG. 11B, operation of the toner replenishing device 160 thus configured will be described.

While the toner bottle 38 is transported or stored before being mounted to the container mount, the nozzle receiving mouth 139*a* is closed by the shutter 140 urged by the coil spring 142. That is to say, the toner bottle 38 is in an almost sealed state as communication is blocked between the nozzle receiving mouth 139*a* and the supply inlet 139*b*.

From this state, as shown in FIG. 7, the toner bottle 38 is horizontally inserted into the container mount with the opening 138*d* forming a leading end. As the insertion proceeds, the end of the nozzle section 165 comes into contact with the end face 140*a* of the shutter 140. Then, in the case of the toner replenishing device 160 shown in FIG. 7, the protrusion 165*a* at the end of the nozzle section 165 is inserted into the recess 140*b* of the shutter 140, and further the seal member 144 contacts the seal member 168.

When the toner bottle 38 is further moved to the distal side, as shown in FIG. 9, the shutter 140 is pushed to the container body 138 by the nozzle section 165 against biasing force exerted by the coil spring 142. In addition, with the movement of the toner bottle 38, the seal member 168 is also pushed to the distal side by the toner bottle 38 against biasing force exerted by the coil spring 169. Thus, the seal member 168 and the seal member 144 are pressed against each other, and sealing of the nozzle receiving mouth 139*a* is thus ensured.

The toner bottle 38 stops moving when fully housed in the container mount and the first end side 138*a* of the container body 138 is rotatably supported by a support, and occupies a mounted position.

The shutter 140 is further slid into the toner bottle 38 by the nozzle section 165 until the toner bottle 38 occupies the mounted position. By the toner bottle 38 occupying the mounted position, the shutter 140 stops sliding and occupies the open position as shown in FIG. 9.

Figure 10:
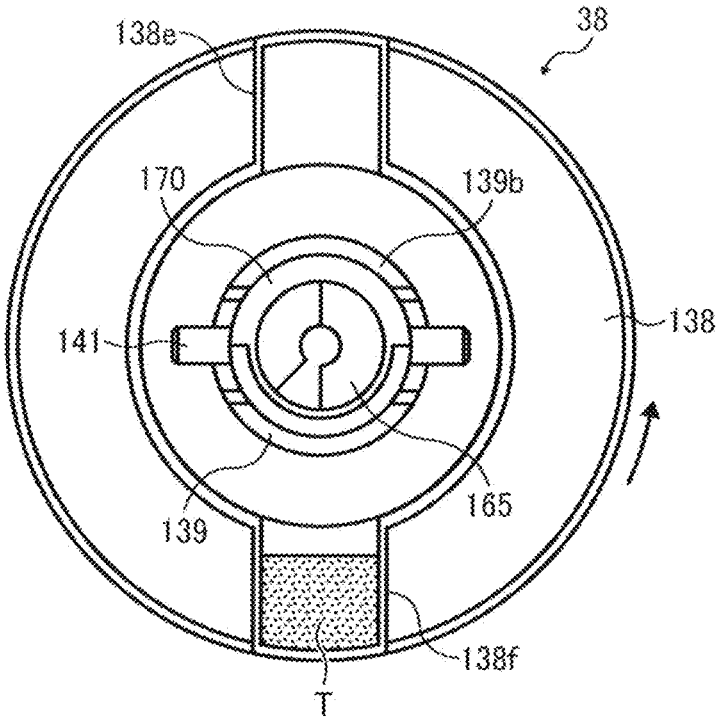
FIG. 10 is a cross-sectional view of the toner bottle and the conveying nozzle shown in FIG. 9, as viewed in a direction perpendicular to the axial direction.

At that time, not only the nozzle receiving mouth 139*a* but also the supply inlet 139*b* is opened. Then, as shown in FIG. 10, the powder inlet 170 is opposed to the supply inlet 139*b*, which is formed in the nozzle receiver 139 and positioned above, thus communicating with the interior of the toner bottle 38.

In the toner bottle 38 configured as described above, the nozzle section 165 of the conveying nozzle 162 having the powder inlet 170 is inserted into the second end portion of the container body 138. The toner bottle 38 further includes the nozzle receiver 139 having the nozzle receiving mouth 139*a* for supplying the toner in the container body 138 to the powder inlet 170. The toner bottle 38 further includes the shutter 140 supported by the nozzle receiver 139 to open and close the nozzle receiving mouth 139*a*. The shutter 140 slides in response to insertion of the nozzle section 165 into the nozzle receiver 139 to open and close the nozzle receiving mouth 139*a* and the supply inlet 139*b*. With this configuration, the nozzle receiving mouth 139*a* and the supply inlet 139*b* are kept closed until the nozzle section 165 is inserted into the nozzle receiver 139.

When the shutter 140 slides in response to insertion of the nozzle section 165 into the nozzle receiver 139, the nozzle receiving mouth 139*a* is opened, and the shutter 140 pushes toner accumulating around the supply inlet 139*b* to the inner side of the toner bottle 38. Consequently, space is secured around the supply inlet 139*b*, which enables reliable supply of toner to the powder inlet 170. Thus, the toner contained in the toner bottle 38 can be reliably discharged to the outside the toner bottle 38, while inhibiting leak and scattering of toner.

When the image forming apparatus 200 is actuated with the toner bottle 38 mounted in the container mount and a toner supply signal is outputted from the controller 100, the driving motors 182A and 182B shown in FIG. 8 are driven.

When the driving motor 182A is driven, drive force thereof is transmitted to the gear 143 via the gear 184, thus rotating the toner bottle 38. Simultaneously, the drive force of the driving motor 182A is also transmitted via the gear 183 to the conveying screw 167 in the nozzle section 165, and the conveying screw 167 rotates in a direction to transport the toner to the connection channel 166.

By contrast, when the driving motor 182B is driven, driving force thereof is transmitted via the gear 185 shown in FIG. 7 to the conveying screw 161B inside the conveyance channel 161, and the conveying screw 161B rotates in a direction to transport toner to the developing device 7.

When the toner bottle 38 rotates, the toner contained therein is transported to the second end side 138*b* by an action of the spiral protrusion 138*c* and then is mixed with toner accumulated in the lower part of the second end portion.

Figure 11A:
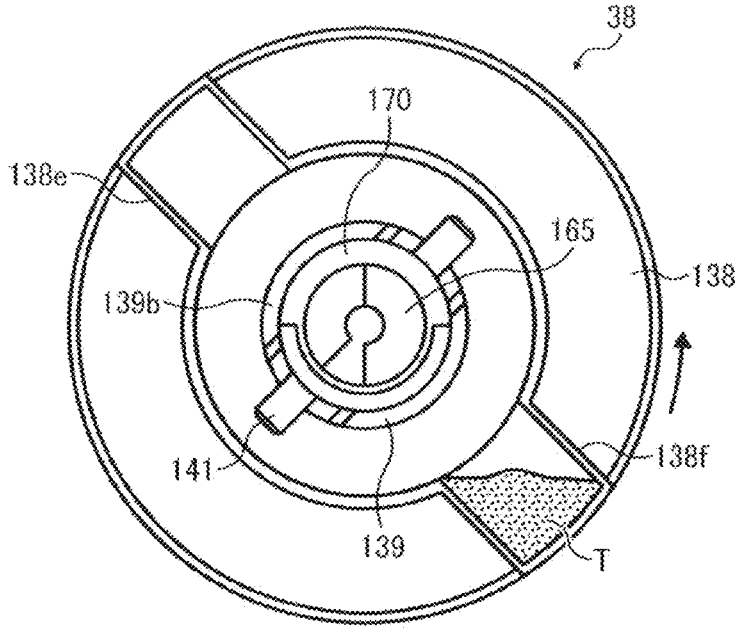
FIG. 11A is a cross-sectional view illustrating relative positions of a supply inlet and a scooping portion of the toner bottle shown in FIG. 10, when the toner bottle rotates.
Figure 11B:
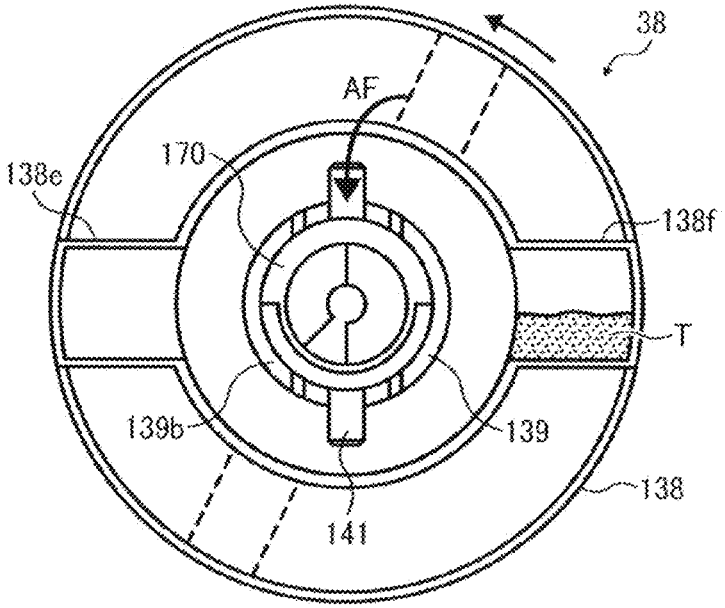
FIG. 11B illustrates a cross-sectional view illustrating a state in which the supply inlet is shifted from a power receiving portion as the toner bottle shown in FIG. 10 rotates.

The relative positions of the supply inlet 139*b* formed in the nozzle receiver 139 and the scooping portion 138*f* of the toner bottle 38 do not change when the toner bottle 38 rotates. Accordingly, as shown in FIG. 11A, when the toner bottle 38 rotates, due to the rotation, the toner accumulated in the lower part of the toner bottle 38 is lifted up by the scooping portion 138*f*. The toner thus lifted drops midway, and, as shown in FIG. 11B, toner is then supplied into the nozzle section 165 via the powder inlet 170 when the powder inlet 170 of the nozzle section 165 is almost aligned with the supply inlet 139*b*, which moves in the circumferential direction as the toner bottle rotates.

That is, the toner in the toner bottle 38 is supplied into the nozzle section 165 only in a period during which the powder inlet 170 of the nozzle section 165 and the supply inlet 139*b* of the nozzle receiver 139 overlap while the toner bottle 38 makes one rotation.

The toner supplied into the nozzle section 165 is transported by the conveying screw 167 toward the connection channel 166 and drops on the connection channel 166. The dropped toner is fed into the conveyance channel 161 via the sub-hopper 163 shown in FIG. 7 and further supplied to the developing device 7 as the conveying screw 161B rotates.

The conveying screw 167 is disposed in the nozzle section 165 that is inserted into the nozzle receiver 139 of the toner bottle 38. The conveying screw 167 extends from an interior of the toner bottle 38 to the outside of the toner bottle 38 and can actively discharge toner from the toner bottle 38.

Transporting toner inside the toner bottle 38 by the conveying screw 167 to the sub-hopper 163 is advantageous in that toner conveying capability from the toner bottle 38 to the sub-hopper 163 can be maintained regardless of the amount of toner in the sub-hopper 163. Accordingly, almost all toner contained in the toner bottle 38 can be used.

In image forming apparatuses such as printers, typically, toner inside developing devices is consumed as images are formed. As the amount of toner inside the developing device decreases, image density decreases. Accordingly, the device is refilled with toner (i.e., refill toner) to compensate for the amount of toner consumed. Refill toner is stored in a separate component (toner bottles 38 here). In such a configuration, a toner conveyance mechanism is provided to supply the refill toner from the toner bottle to the developing device. The amount of toner thus conveyed is often controlled by the amount of driving (for example, driving time) of a driving motor of the toner conveyance mechanism.

When toner is conveyed linearly (at one draft) from the toner bottle to the developing device, it is possible that the amount of toner conveyed is different from a target amount, due to the fluidity of toner and the like, depending on environments, the structure of toner conveyance, and conveyance route. In view of the foregoing, it is proposed to provide an intermediate toner container, such as a sub-hopper, between the toner bottle and the developing device to control the amount of toner supplied to the developing device.

The amount of toner supplied can be controlled more accurately by separating a second conveyance device to transport toner from the sub-hopper to the developing device from a first conveyance device to transport toner from the toner bottle to the sub-hopper and driving the first and second conveyance devices separately. This configuration can better meet usage environments of users and thus is convenient for users.

The toner conveyance amount to the developing device directly relates to image quality and has significant effects on image quality particularly in configurations in which two-component developer is used.

In configurations in which the first and second conveyance devices are not driven separately (i.e., not controlled separately), it is desirable that toner recovery action, the necessity of which arises in replacement of toner bottles, is not started during image formation. If toner recovery action is executed, productivity decreases since image formation is not feasible during toner recovery action. It is to be noted that "toner recovery action" used here means operation for compensating for the shortage of toner in the conveyance channel and the toner bottle that arises as toner is transported from the toner bottle to the sub-hopper.

By contrast, driving the first and second conveyance devices separately is advantageous in that toner recovery action can be executed independently while the function to maintain a desirable image quality secured. That is, conveyance of toner to the developing device, which contributes to image quality, is secured. Therefore, image formation productivity does not decrease.

Additionally, while control of toner conveyance from the sub-hopper to the developing device, which directly relates to image quality, is designed carefully, that from the toner bottle to the sub-hopper is simple. Since the conveyance of toner from the toner bottle to the sub-hopper does not directly contribute to image quality, it does not matter as long as the amount of toner in the sub-hopper is sufficient for conveyance of toner to the developing device.

Generally, toner conveyance from the toner bottle to the sub-hopper is controlled according to a toner amount detector provided to an inner wall of the sub-hopper to detect the amount of toner in the sub-hopper. When the detected amount of toner in the sub-hopper falls below a predetermined amount, toner is supplied thereto from the toner bottle.

However, there is the possibility of erroneous detection when toner is not present around the toner amount detector or the toner amount detector is out of order. That is, it may be erroneously detected that the toner amount in the sub-hopper is below the predetermined amount although the amount of toner therein is greater than the predetermined amount.

In cases where the toner amount detector erroneously detects that the amount of toner is greater although no toner remains in the sub-hopper, toner is not transported from the toner bottle to the sub-hopper. If this situation continues, image quality is affected. For example, image density decreases. In this case, the toner conveyance device and the like are not damaged, and the situation can be handled.

However, the opposite situation may cause damage. That is, if toner amount detector erroneously detects that the amount of toner is smaller in spite of a sufficient amount of toner stored in the sub-hopper, toner conveyance from the toner bottle to the sub-hopper is repeated until it detects that the amount of toner is sufficient.

If the amount conveyed to the sub-hopper from the toner bottle exceeds the capacity of the sub-hopper, there arise risks that the sub-hopper overflows with toner, causing toner leak, and damage is caused in components of the second conveyance device for toner conveyance from the toner bottle to the sub-hopper. In other words, that situation is fatal to the image forming apparatus, and recovery is difficult.

The inventors of the present invention recognize that this greatly relates to the toner conveyance capability from the toner bottle to the sub-hopper. When the amount of toner remaining in the toner bottle becomes small, typically the amount of toner discharged from the toner bottle becomes small, which makes it difficult to use up all of toner remaining in the toner bottle. Therefore, currently, there are mechanisms to actively discharge toner inside the toner bottle to use up toner stored inside the toner bottle.

In configurations without such a mechanism to actively discharge toner from the toner bottle, even if an amount of toner exceeding the capacity is supplied to the sub-hopper, toner is not materially supplied to the sub-hopper above a certain level. Specifically, although the toner conveyance device tries to keep supplying toner from the toner bottle to the sub-hopper when the sub-hopper becomes full, toner is not materially supplied thereto since the toner conveyance capability is not high.

By contrast, configurations provided with such a mechanism to actively discharge toner from the toner bottle are aimed at actively transporting toner from the toner bottle to the sub-hopper, and the capability to supply toner from the toner bottle to the sub-hopper is high. The inventors of the present invention have found that, even if the sub-hopper becomes full with toner exceeding the capacity, the mechanism keeps supplying toner to the sub-hopper as long as the controller continues to instruct toner conveyance. In other words, even if the sub-hopper is crammed up with toner, the mechanism keeps supplying toner to the sub-hopper until the toner amount detector sends to the controller a signal indicating that the amount of toner in the sub-hopper is proper. Then, there is a risk that the channel of toner conveyance extending from the toner bottle to the sub-hopper is crammed up with toner, and toner is pressed to solidify. Consequently, toner leaks from the sub-hopper, or the toner conveyance device is damaged.

In view of the foregoing, in the image forming apparatus 200 according to the present embodiment, the controller 100 controls driving of the first conveyance device using data relating to driving of the second conveyance device, in addition to the detection results generated by the toner amount detector 150, indicating the detected amount of toner in the sub-hopper 163.

It is to be noted that, in the present embodiment, the driving motor 182A, the conveying screw 167, the spiral protrusion 138*c* protruding inward from the inner circumferential face of the toner bottle 38, and the like together form the first conveyance device. Additionally, the driving motor 182B, the conveying screw 161B, and the like together form the second conveyance device.

Additionally, "data relating to driving of the second conveyance device" includes data of driving of the conveying screw 161B by the driving motor 182B, data that suggests that conveying screw 161B is driven, and the like.

In the present embodiment, even if the toner amount detector 150 detects that the amount of toner in the sub-hopper 163 is smaller than the predetermined amount, the first conveyance device is not driven when the second conveyance device has not yet driven after the previous conveyance of developer (i.e., toner) from the toner bottle 38 to the sub-hopper 163.

With this control, toner is not transported from the toner bottle 38 to the sub-hopper 163 when the amount of toner in the sub-hopper 163 is equal to or greater than the predetermined amount although the toner amount detector 150 erroneously detects that the amount of toner in the sub-hopper 163 is smaller than that. Accordingly, this control can inhibit the inconvenience that the amount conveyed to the sub-hopper 163 from the toner bottle 38 exceeds the capacity of the sub-hopper 163, thus inhibiting overflow of the sub-hopper 163 with toner and damage to the toner conveyance mechanism.

Next, descriptions are given below of control of toner replenishing performed by the toner replenishing device 160 according to the present embodiment.

(First Embodiment)

FIG. 1 is a flowchart illustrating a control procedure of toner conveyance from the toner bottle 38 to the sub-hopper 163. It is to be noted that, in the flowcharts shown in FIGS. 1 and 12A through 13B, broken arrow indicate flow of data.

At S1, the controller 100 starts controlling toner conveyance from the toner bottle 38 to the sub-hopper 163, triggered by a print job start signal, at a predetermined timing, or in a predetermined cycle.

At S2, the controller 100 acquires a detected toner remaining amount indicating the amount of toner remaining in the sub-hopper 163 based on the detection results generated by the toner amount detector 150 provided to the inner wall of the sub-hopper 163 and then compares the detected toner remaining amount with a predetermined threshold for the toner remaining amount. Then, the controller 100 determines whether to execute toner conveyance from the toner bottle 38 to the sub-hopper 163.

When the detected toner remaining amount is equal to or greater than the threshold therefor (No at S2), toner conveyance from the toner bottle 38 to the sub-hopper 163 is deemed unnecessary, and the controller 100 completes the control of toner conveyance from the toner bottle 38 to the sub-hopper 163 at S5.

It is to be noted that when the detected toner remaining amount is not available, toner conveyance from the toner bottle 38 to the sub-hopper 163 is deemed unnecessary. That is, it is deemed that the amount of toner in the sub-hopper 163 is greater than the threshold therefor.

By contrast, when the detected toner remaining amount is smaller than the threshold therefor (Yes at S2), toner conveyance from the toner bottle 38 to the sub-hopper 163 is deemed necessary. At S3 the controller 100 judges whether or not the conveying screw 161B has been driven based on the data relating to driving of the conveying screw 161B. Alternatively, the controller 100 presumes whether or not the conveying screw 161B has been driven based on data suggesting that conveying screw 161B is driven.

It is to be noted that data relating to driving of the conveying screw 161B includes driving time of the driving motor 182B, rotational frequency thereof, and the like. The data suggesting that conveying screw 161B is driven includes the amount of toner discharged from the developing device 7 (i.e., image data of printed images). As such data relating to (or suggesting) driving of the conveying screw 161B, for example, data acquired after the previous toner conveyance from the toner bottle 38 to the sub-hopper 163 can be used.

When it is judged or presumed that the conveying screw 161B has not been driven (No at S3), the controller 100 sets the amount of toner to be transported to the sub-hopper 163 to zero (0). Then, at S5, the control of toner conveyance is completed without transporting toner from the toner bottle 38 to the sub-hopper 163.

It is to be noted that, when the data relating to (or suggesting) driving of the conveying screw 161B is not input to the controller 100, the controller 100 judges that the conveying screw 161B has not driven and sets the necessary amount of toner transported to the sub-hopper 163 to zero (0) as described above.

By contrast, when it is judged or presumed that the conveying screw 161B has been driven (Yes at S3), the controller 100 calculates the amount of toner to be transported to the sub-hopper 163.

It is to be noted that the amount of toner to be transported can be either fixed value or variable. For example, that is a fixed amount with which the toner conveyance amount becomes stable. In this case, the fixed amount can be smaller than an estimated amount of toner discharged from the developing device 7. Additionally, the amount of toner to be transported may be variable with its upper limit set to the estimated amount of toner discharged from the developing device 7, calculated from the driving amount (estimated driving amount) of the conveying screw 161B.

At S4, the toner conveyance device to transport toner to the sub-hopper 163 is driven. Specifically, the driving motor 182A is turned on for a time period T1 (ms) corresponding to the amount of toner to be transported calculated by the controller 100, and the conveying screw 167 transports toner from the toner bottle 38 to the sub-hopper 163.

It is to be noted that, when toner conveyance from the toner bottle 38 to the sub-hopper 163 is completed properly, the above-described sequence of control operation is repeated as required. If toner conveyance from the toner bottle 38 to the sub-hopper 163 is ended abnormally, error handling, such as error log recording or error message display, is performed, and the sequence of control operation is completed.

(Second Embodiment)

Figure 12A:
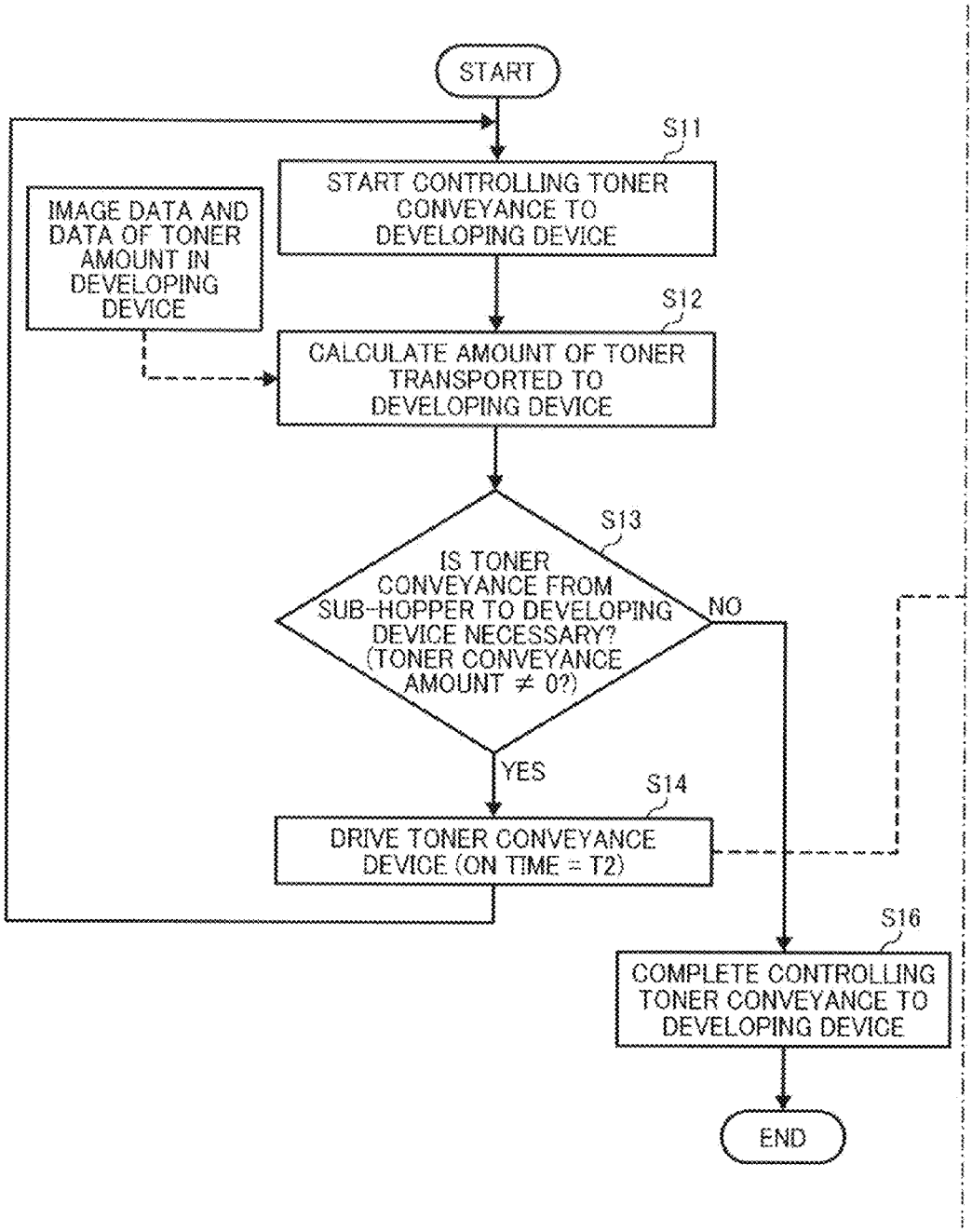
FIGS. 12A and 12B are flowcharts illustrating an example control procedure of toner conveyance from a sub-hopper to the developing device, according to another embodiment.
Figure 12B:
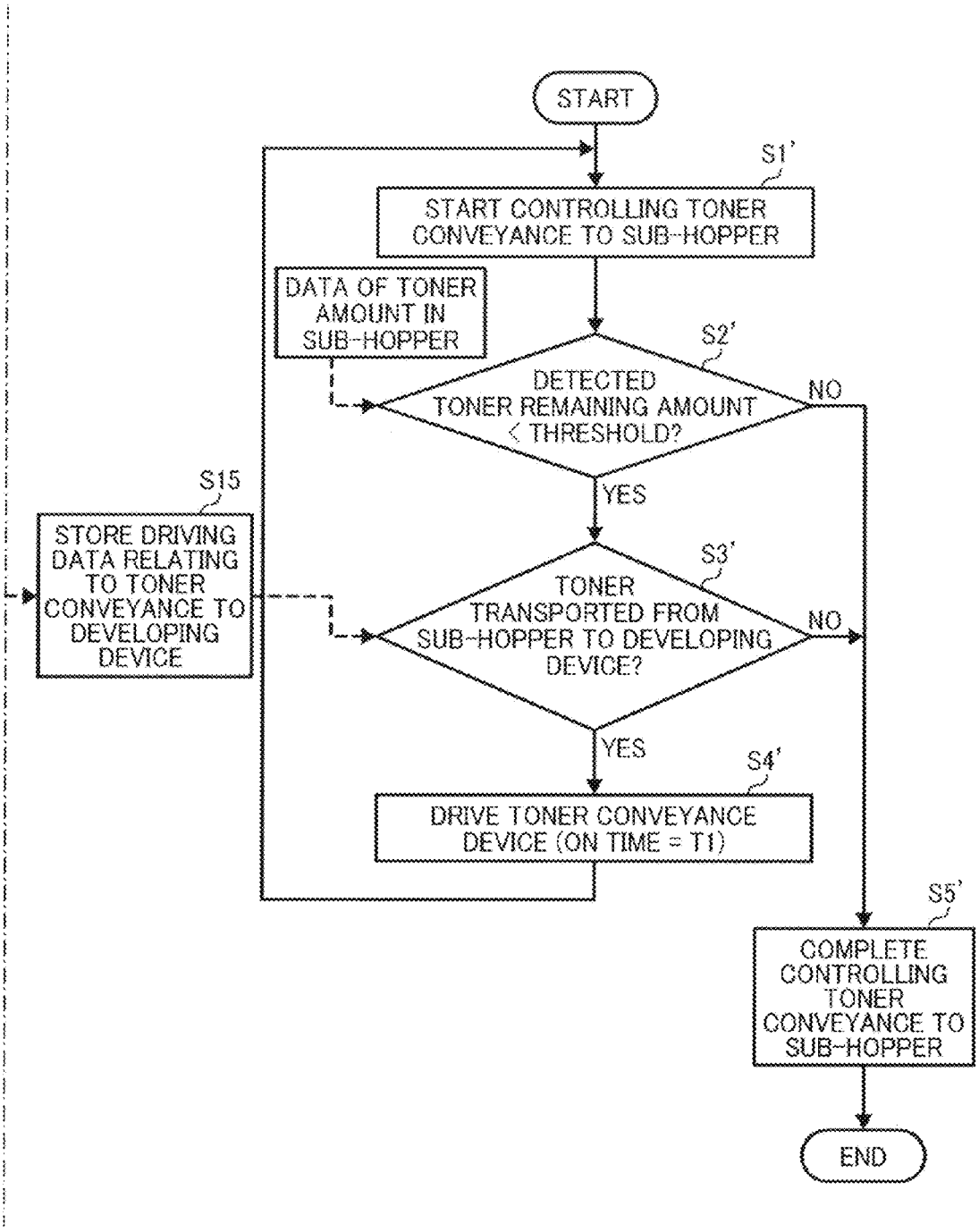

FIGS. 12A and 12B are flowcharts illustrating an example control procedure of toner conveyance according to a second embodiment.

In the second embodiment described below, control of toner conveyance from the sub-hopper 163 to the developing device 7 is performed in parallel to control of toner conveyance from the toner bottle 38 to the sub-hopper 163.

In the present embodiment, toner conveyance from the toner bottle 38 to the sub-hopper 163 and that from the sub-hopper 163 to the developing device 7 are controlled separately using controllers 100A and 100B (see FIG. 6). Configurations of the controllers 100A and 100B can be similar to that of the controller 100 described above with reference to FIG. 6.

[Control of Toner Conveyance from the Sub-Hopper 163 to the Developing Device 7]

Referring to FIGS. 12A and 12B, a control operation of toner conveyance from the sub-hopper 163 to the developing device 7 is described.

At S11, the controller 100B starts controlling toner conveyance from the sub-hopper 163 to the developing device 7, triggered by a print job start signal, at a predetermined timing, or in a predetermined cycle.

At S12, the amount of toner to be transported to the developing device 7 is calculated based on at least one of printed image data and data indicating the amount of toner in the developing device 7 (for example, detection results generated by the density sensor 10 of magnetic permeability detection type).

It is to be noted that, as the data indicating the amount of toner in the developing device 7, use of toner density (or concentration of toner in developer) inside the developing device 7 is desirable to accurately determine and control the amount of toner transported.

At S13, the controller 100B determines whether to execute toner conveyance from the sub-hopper 163 to the developing device 7 according to the calculated amount of toner to be transported to the developing device 7.

When the amount of toner to be transported is zero (0), toner conveyance to the developing device 7 is deemed unnecessary (No at S13). At S16, the control operation is completed without performing toner conveyance from the sub-hopper 163 to the developing device 7.

By contrast, when the amount of toner to be transported is not zero (Yes at S13), toner conveyance to the developing device 7 is deemed necessary. At S14, the toner conveyance device to transport toner to the developing device 7 is driven. Specifically, the driving motor 182B is turned on for a time period T2 (ms) corresponding to the calculated amount of toner to be transported, and the conveying screw 161B transports toner from the sub-hopper 163 to the developing device 7.

Additionally, as S15, driving data of the driving motor 182B resulting from toner conveyance from the sub-hopper 163 to the developing device 7 is stored in the memory device such as the RAM 102. The stored driving data of the driving motor 182B is used by the controller 100A at S3' in FIG. 12B, in judgment of whether or not the conveying screw 161B has been driven.

When toner conveyance from the sub-hopper 163 to the developing device 7 is completed properly at S16, the above-described sequence of control operation is repeated as required. If toner conveyance from the sub-hopper 163 to the developing device 7 is ended abnormally, error handling, such as error log recording or error message display, is performed, and the sequence of control operation is completed.

[Control of Toner Conveyance from the Toner Bottle 38 to the Sub-Hopper 163]

Referring to FIG. 12B, toner conveyance from the toner bottle 38 to the sub-hopper 163 are controlled by the controller 100A at steps S1 to S5', which are similar S1 to S5 shown in FIG. 1, and descriptions thereof are omitted.

(Third Embodiment)

Figure 13A:
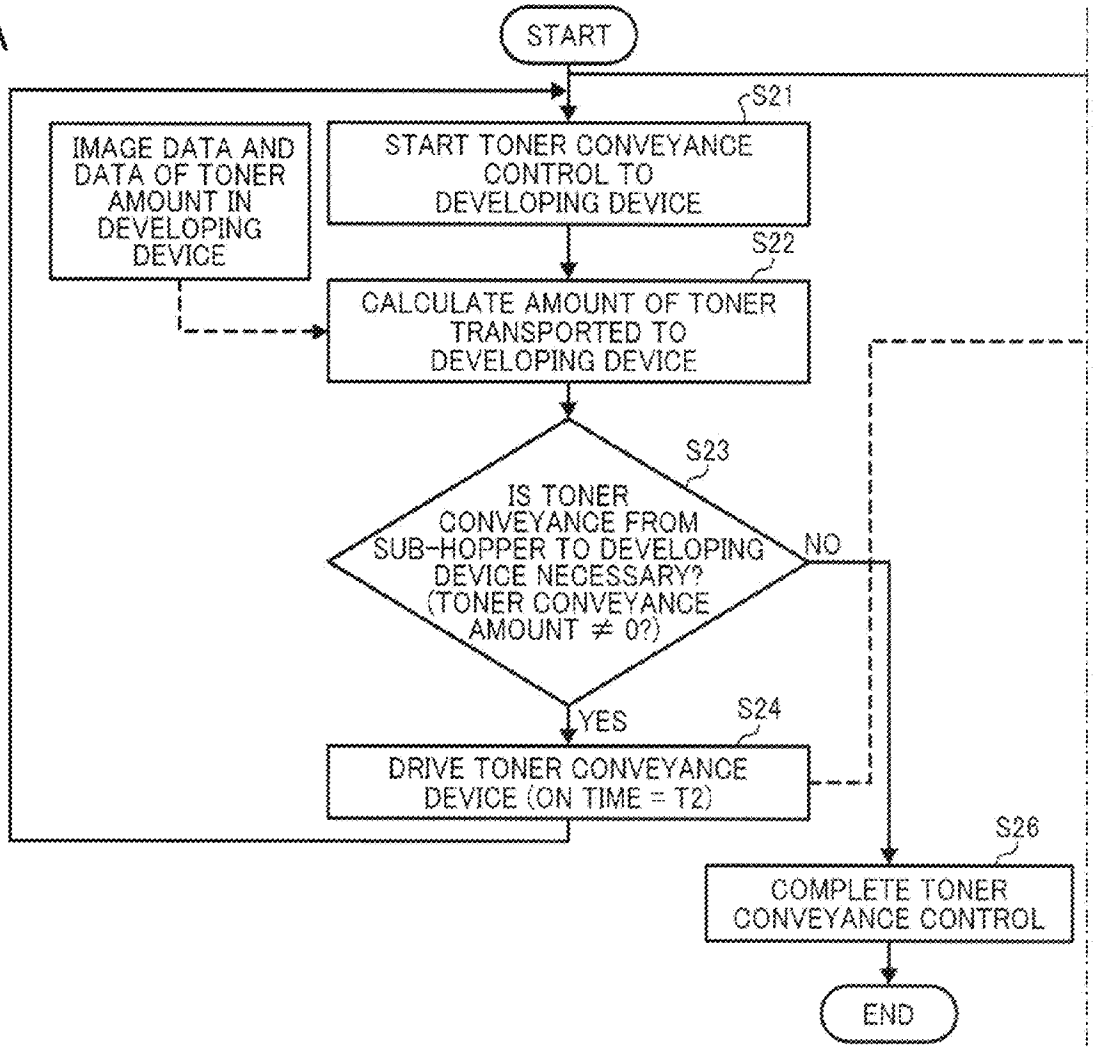
FIGS. 13A and 13B are flowcharts illustrating a control procedure of both of toner conveyance from the toner bottle to the sub-hopper and that from the sub-hopper to the developing device, according to yet another embodiment.
Figure 13B:
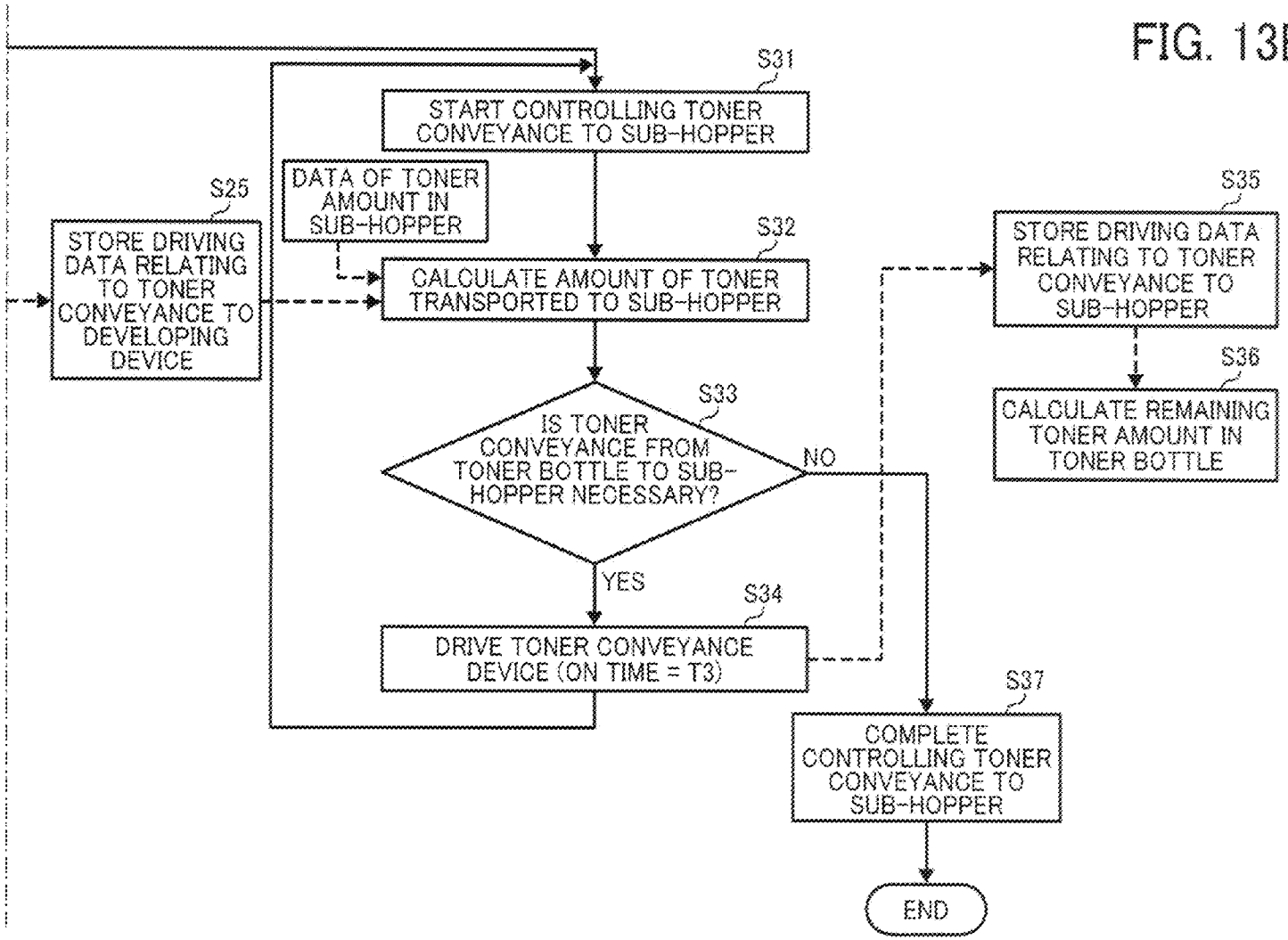

FIGS. 13A and 13B are flowcharts illustrating a control procedure according to a third embodiment, which includes both of toner conveyance from the toner bottle 38 to the sub-hopper 163 and that from the sub-hopper 163 to the developing device 7.

In the present embodiment, toner conveyance from the toner bottle 38 to the sub-hopper 163 and that from the sub-hopper 163 to the developing device 7 are controlled by an identical controller, namely, the controller 100 shown in FIG. 6.

[Control of Toner Conveyance from the Sub-Hopper 163 to the Developing Device 7]

At S21, the controller 100 starts controlling toner conveyance from the sub-hopper 163 to the developing device 7, triggered by a print job start signal, at a predetermined timing, or in a predetermined cycle.

At S22, the amount of toner to be transported from the sub-hopper 163 to the developing device 7 is calculated based on at least one of printed image data and data indicating the amount of toner in the developing device 7 (for example, detection results generated by the density sensor 10 of magnetic permeability detection type).

At S23, the controller 100 determines whether to execute toner conveyance from the sub-hopper 163 to the developing device 7 according to the calculated amount of toner to be transported to the developing device 7.

When the amount of toner to be transported is zero (0), toner conveyance to the developing device 7 is deemed unnecessary (No at S23). At S26, the control operation is completed without performing toner conveyance from the sub-hopper 163 to the developing device 7.

By contrast, when the amount of toner to be transported is not zero (Yes at S23), toner conveyance to the developing device 7 is deemed necessary. At S24, the toner conveyance device to transport toner to the developing device 7 is driven. Specifically, the driving motor 182B is turned on for a time period T2 (ms) corresponding to the calculated amount of toner to be transported, and the conveying screw 161B transports toner from the sub-hopper 163 to the developing device 7.

Additionally, at S25 shown in FIG. 13B, driving data of the driving motor 182B resulting from toner conveyance from the sub-hopper 163 to the developing device 7 is stored in the memory device such as the RAM 102. The stored driving data of the driving motor 182B is used in judgment of whether or not the conveying screw 161B has been driven (at S32), included in the control of toner conveyance from the toner bottle 38 to the sub-hopper 163 described later, and the like.

When toner conveyance from the sub-hopper 163 to the developing device 7 is completed properly, the above-described sequence of control operation is repeated as required.

[Control of Toner Conveyance from the Toner Bottle 38 to the Sub-Hopper 163]

At S31, the controller 100 starts controlling toner conveyance from the toner bottle 38 to the sub-hopper 163 triggered by a print job start signal, at a predetermined timing, or in a predetermined cycle.

At S32, based on the detected toner remaining amount in the sub-hopper 163, the controller 100 calculates the amount of toner to be transported from the toner bottle 38 to the sub-hopper 163. At that time, the controller 100 further retrieves the data relating to driving of the driving motor 182B stored at S25.

At S33, the controller 100 determines whether to execute toner conveyance from the toner bottle 38 to the sub-hopper 163 based on the result of comparison of the detected toner remaining amount in the sub-hopper 163 with the threshold, the retrieved data of driving of the driving motor 182B, and the like.

The controller 100 determines that toner conveyance from the toner bottle 38 to the sub-hopper 163 is necessary (Yes at S33) when requirements 1) the detected toner remaining amount is smaller than the threshold and 2) it is determined or presumed that the conveying screw 161B has been driven, are satisfied.

At S34, the toner conveyance device to transport toner to the sub-hopper 163 is driven. Specifically, the driving motor 182A is turned on for a time period T3 (ms) corresponding to the calculated amount of toner to be transported, and the conveying screw 167 transports toner from the toner bottle 38 to the sub-hopper 163.

It is to be noted that, when toner conveyance from the toner bottle 38 to the sub-hopper 163 is completed properly at S37, the above-described sequence of control operation is repeated as required.

Additionally, as S35, data relating to driving of the driving motor 182A resulting from toner conveyance from the toner bottle 38 to the sub-hopper 163 is stored in the memory device such as the RAM 102. The stored data relating to the driving of the driving motor 182A is used in calculation of the amount of toner remaining in the toner bottle 38 (at S36).

By contrast, when the detected toner remaining amount is not smaller than the threshold or it is determined or presumed that the conveying screw 161B is not driven (No at S33), the control operation is completed without transporting toner from the toner bottle 38 to the sub-hopper 163 at S37.

At that time, the above processing is not sufficient in configurations, such as the second embodiment, that include the separate controllers 100A and 100B to control toner conveyance from the toner bottle 38 to the sub-hopper 163 and that from the sub-hopper 163 to the developing device 7, respectively. Specifically, in cases where the controllers 100A and 100B are independent of each other, an additional step is necessary when each controller has not yet acquired necessary data.

By contrast, when the controller 100 controls both of toner conveyance from the toner bottle 38 to the sub-hopper 163 and that from the sub-hopper 163 to the developing device 7, the controller 100 itself governs acquisition of necessary data. Accordingly, timing of input and output, in particular, the order of control processes, can be managed properly.

Additionally, since the single controller 100 controls driving of multiple conveyance devices such as the conveying screw 167 and the conveying screw 161B, the configuration of the controller 100 can be simplified. Additionally, it is desirable to use the data relating to driving of the conveying screw 161B for the control data of driving of the conveying screw 167 since data input and output can be relatively easy when the control operation is executed by the single controller 100.

Further, error handling can be easier since failure in inputting data to the controller 100 can be limited to errors such as output error of the toner amount detector 150.

It is to be noted that the steps in the above-described flowcharts may be executed in an order different from that in the flowchart.

Still further, the aforementioned control methods may be embodied in the form of an apparatus, method, system, computer program and computer program product, including, but not limited to, any of the structure for performing the methodology illustrated in the drawings. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

The various configurations according to the present inventions can attain specific effects as follows.

Aspect A: An image forming apparatus includes an image bearer, such as the photoreceptor 3, a developing device to develop a latent image formed on the image bearer with developer such as toner, a developer container such as the toner bottle 38 to store developer used by the developing device, a temporary reservoir, such as the sub-hopper 163, to temporarily store developer supplied from the developer container and having an outlet to discharge the temporarily stored developer to the developing device, a first conveyance device, such as the conveying screw 167, to transport developer from the developer container to the temporary reservoir, a second conveyance device, such as the conveying screw 161B, to transport developer from the temporary reservoir to the developing device, and a first developer amount detector, such as the toner amount detector 150, to detect the amount of developer in the temporary reservoir.

The image forming apparatus further includes a first controlling unit, such as the controller 100A, to control driving of the first conveyance device based on data relating to driving of the second conveyance device and a detection result generated by the first developer amount detector.

In the above-described embodiment, the first controlling unit controls the first toner conveyance device to transport developer from the developer container to the temporary reservoir using, in addition to the detected amount of toner inside the temporary reservoir, data relating to driving of the second conveyance device to transport developer from the temporary reservoir to the developing device.

When the requirements of 1) the first developer amount detector detects that the amount of developer in the temporary reservoir is smaller than the predetermined amount and 2) the second conveyance device has been driven after the previous conveyance of developer to the temporary reservoir are satisfied, the first toner conveyance device is driven, thereby transporting developer from the developer container to the temporary reservoir. The amount of developer transported to the temporary reservoir at that time can be similar to the amount of developer transported from the temporary reservoir to the developing device by the second conveyance device. The amount can be obtained based to the data relating to driving of the second conveyance device.

With this operation, the amount of developer transported by the first toner conveyance device to the temporary reservoir does not exceeds the capacity of the temporary reservoir, and the amount of developer in the temporary reservoir can be kept at or above the predetermined amount.

By contrast, after the first toner conveyance device transports developer to the temporary reservoir, the amount of developer in the temporary reservoir does not decrease unless developer is supplied from the temporary reservoir to the developing device. Even if the first developer amount detector detects that the amount of developer in the temporary reservoir is smaller than the predetermined amount, there is a possibility that the amount of developer in the temporary reservoir is equal to or greater than the predetermined amount in a case where the second conveyance device has not yet transported developer from the temporary reservoir. Therefore, even if the requirement 1) is satisfied, the first toner conveyance device is not driven as long as the second conveyance device has not been driven after the previous conveyance of developer to the temporary reservoir.

With this operation, even in cases where the first developer amount detector erroneously detects that the amount of developer in the temporary reservoir is smaller than the predetermined amount in spite of the sufficient amount of developer therein, developer is not transported to the temporary reservoir, and the temporary reservoir can be protected from overflowing with developer.

Aspect B: In aspect A, the image forming apparatus further includes a second developer amount detector, such as the density sensor 10, to detect the amount of developer in the developing device, an image data acquisition unit, such as the controller 100, to acquire image data used to form the latent image, and a second controlling unit, such as the controller 100B, to control driving of the second conveyance device based on the image data acquired by the image data acquisition unit and a detection result generated by the second developer amount detector.

This configuration can secure image quality since the driving of the second conveyance device is controlled based on data to secure image quality.

Aspect C: In aspect B, a single controller includes the first controlling unit and the second controlling unit. With this configuration, since the single controller controls driving of multiple conveyance devices, the control configuration can be simplified as described above. Additionally, it is desirable to use the data relating to driving of the second conveyance device to control the first toner conveyance device since data input and output can be relatively easy when the control operation is executed by the common controller.

Aspect D: In any of aspects A, B, and C, the first toner conveyance device is configured such that capability to transport developer conveyance from the developer container to the temporary reservoir can be maintained regardless of the amount of developer in the temporary reservoir. With this configuration, developer contained in the developer container can be used up as described above.

Aspect E: In any of aspects A, B, C, and D, developer includes at least toner, and the data indicating the amount of developer in the developing device includes the density of toner (or the concentration of toner in developer). With this configuration, the amount of toner to be transported can be accurately determined and controlled.

Aspect F: In any of aspects A, B, C, D, and E, the first developer amount detector can be a piezoelectric sensor or an optical sensor provided to an inner wall of the temporary reservoir. With this configuration, the amount of developer can be detected at a lower cost and easily.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an image bearer on which a latent image is formed;

a developing device to develop with developer the latent image formed on the image bearer;

a developer container to contain developer;

a temporary reservoir to temporarily store developer supplied from the developer container, the temporary reservoir having an outlet to discharge the stored developer to the developing device;

a first conveyance device to transport developer from the developer container to the temporary reservoir;

a second conveyance device to transport developer from the temporary reservoir to the developing device;

a first developer amount detector to detect an amount of developer in the temporary reservoir; and a controller configured to control driving of the first conveyance device based on a detection result generated by the first developer amount detector and data relating to driving of the second conveyance device, wherein the developer in the developer container and the temporary reservoir is toner, the first developer amount detector comprises either one of a piezoelectric sensor and an optical sensor, and the first developer amount detector is provided to an inner wall of the temporary reservoir.

2. The image forming apparatus according to claim 1, wherein the first toner conveyance device further comprises a spiral protrusion protruding inward from an inner circumferential face of the developer container.

3. The image forming apparatus according to claim 1, further comprising:

a first drive source to drive the first conveyance device; and a second drive source to drive the second conveyance device, wherein the controller controls the first and second drive sources independently.

4. The image forming apparatus according to claim 3, wherein the developer container is substantially cylindrical and rotatable about an axis extending in a longitudinal direction of the developer container, and the developer container and the first conveyance device are driven simultaneously by the first drive source.

5. The image forming apparatus according to claim 3, wherein the first conveyance device comprises a conveying screw partly inserted into the developer container, the conveying screw disposed to extend from an interior of the developer container to outside of the developer container.

6. The image forming apparatus according to claim 1, further comprising:

a second developer amount detector to detect an amount of developer in the developing device; and an image data acquisition unit to acquire image data used to form the latent image, wherein the controller further controls driving of the second conveyance device based on the image data acquired by the image data acquisition unit and a detection result generated by the second developer amount detector.

7. The image forming apparatus according to claim 6, wherein the developer in the developing device includes toner and carrier, and the detection result generated by the second developer amount detector comprises a density of toner inside the developing device.

8. An image forming apparatus comprising:

an image bearer on which a latent image is formed;

a developing device to develop with developer the latent image formed on the image bearer;

a developer container to contain developer;

a temporary reservoir to temporarily store developer supplied from the developer container, the temporary reservoir having an outlet to discharge the stored developer to the developing device;

a first conveyance device to transport developer from the developer container to the temporary reservoir;

a second conveyance device to transport developer from the temporary reservoir to the developing device;

a first developer amount detector to detect an amount of developer in the temporary reservoir, the first developer amount detector being on an inner wall of the temporary reservoir; and a controller configured to control driving of the first conveyance device based on a detection result generated by the first developer amount detector and data relating to driving of the second conveyance device, wherein even if the first developer amount detector detects the amount of developer in the temporary reservoir is less than a predetermined amount, the controller is configured to not drive the first conveyance device to transport the developer from the developer container to the temporary reservoir when the second conveyance device has yet to transport the developer from the temporary reservoir to the developing device, and wherein the first developer amount detector is provided to the inner wall of the temporary reservoir such that a part of the first developer amount detector is directly mounted on the inner wall of the temporary reservoir.

9. The image forming apparatus according to claim 8, wherein the first developer amount detector comprises either one of a piezoelectric sensor and an optical sensor.

10. The image forming apparatus according to claim 8, further comprising:

a second developer amount detector to detect an amount of developer in the developing device; and an image data acquisition unit to acquire image data used to form the latent image, wherein the controller further controls driving of the second conveyance device based on the image data acquired by the image data acquisition unit and a detection result generated by the second developer amount detector.

11. The image forming apparatus according to claim 10, wherein the developer in the developing device includes toner and carrier, and the detection result generated by the second developer amount detector comprises a density of toner inside the developing device.

12. The image forming apparatus according to claim 8, further comprising:

a first drive source to drive the first conveyance device; and a second drive source to drive the second conveyance device, wherein the controller controls the first and second drive sources independently.

13. The image forming apparatus according to claim 12, wherein the first conveyance device comprises a conveying screw partly inserted into the developer container, the conveying screw disposed to extend from an interior of the developer container to outside of the developer container.

14. The image forming apparatus according to claim 13, wherein the first conveyance device further comprises a spiral protrusion protruding inward from an inner circumferential face of the developer container.

15. The image forming apparatus according to claim 14, wherein the developer container is substantially cylindrical and rotatable about an axis extending in a longitudinal direction of the developer container, and the developer container and the conveying screw are driven simultaneously by the first drive source.

16. An image forming apparatus comprising:

an image bearer on which a latent image is formed;

a developing device to develop with developer the latent image formed on the image bearer;

a developer container to contain developer;

a temporary reservoir to temporarily store developer supplied from the developer container, the temporary reservoir having an outlet to discharge the stored developer to the developing device;

a first conveyance device to transport developer from the developer container to the temporary reservoir;

a second conveyance device to transport developer from the temporary reservoir to the developing device;

a first developer amount detector to detect an amount of developer in the temporary reservoir;

a controller to control driving of the first conveyance device based on a detection result generated by the first developer amount detector and data relating to driving of the second conveyance device;

a second developer amount detector to detect an amount of developer in the developing device; and an image data acquisition unit to acquire image data used to form the latent image, wherein the controller further controls driving of the second conveyance device based on the image data acquired by the image data acquisition unit and a detection result generated by the second developer amount detector.

17. The image forming apparatus according to claim 16, wherein the developer in the developing device includes toner and carrier, and the detection result generated by the second developer amount detector comprises a density of toner inside the developing device.

18. The image forming apparatus according to claim 16, wherein the developer in the developer container and the temporary reservoir is toner, the first developer amount detector comprises either one of a piezoelectric sensor and an optical sensor, and the first developer amount detector is provided to an inner wall of the temporary reservoir.

19. The image forming apparatus according to claim 16, further comprising:

a first drive source to drive the first conveyance device; and a second drive source to drive the second conveyance device, wherein the controller controls the first and second drive sources independently, and wherein the first conveyance device comprises a conveying screw partly inserted into the developer container, the conveying screw disposed to extend from an interior of the developer container to outside of the developer container.

* * * * *